US007968190B2

(12) United States Patent
Clough

(10) Patent No.: US 7,968,190 B2
(45) **Date of Patent: *Jun. 28, 2011**

(54) PTFE FABRIC ARTICLES AND METHOD OF MAKING SAME

(75) Inventor: Norman Ernest Clough, Landenberg, PA (US)

(73) Assignee: Gore Enterprise Holdings, Inc., Newark, DE (US)

( * ) Notice: Subject to any disclaimer, the term of this patent is extended or adjusted under 35 U.S.C. 154(b) by 249 days.

This patent is subject to a terminal disclaimer.

(21) Appl. No.: 12/340,038

(22) Filed: Dec. 19, 2008

(65) Prior Publication Data

US 2010/0159171 A1 Jun. 24, 2010

(51) Int. Cl.
*D02G 3/00* (2006.01)
*B05D 5/12* (2006.01)

(52) U.S. Cl. ..... 428/364; 427/80

(58) Field of Classification Search ..... 442/1, 164, 442/181, 192, 304, 308, 327, 334; 428/36.1, 428/357, 360, 361, 364, 365, 221, 34.1, 400
See application file for complete search history.

(56) References Cited

U.S. PATENT DOCUMENTS

| | | | | |
|---|---|---|---|---|
| 3,953,566 | A | 4/1976 | Gore | 264/288 |
| 4,187,390 | A | 2/1980 | Gore | 174/102 R |
| 4,208,745 | A | 6/1980 | Okita | 3/1.4 |
| 4,647,416 | A | 3/1987 | Seiler, Jr. et al. | 264/118 |
| 5,264,100 | A * | 11/1993 | Shimohira et al. | 204/296 |
| 5,296,292 | A | 3/1994 | Butters | 428/375 |
| 5,462,781 | A | 10/1995 | Zukowski | 428/36.1 |
| 5,466,509 | A | 11/1995 | Kowligi et al. | 428/141 |
| 5,747,128 | A | 5/1998 | Campbell et al. | 428/35.7 |
| 6,573,311 | B1 | 6/2003 | Martakos et al. | 522/157 |
| 7,615,282 | B2 * | 11/2009 | Lutz et al. | 428/400 |
| 7,736,739 | B2 * | 6/2010 | Lutz et al. | 428/400 |
| 7,740,020 | B2 * | 6/2010 | Lutz et al. | 132/321 |
| 2006/0047311 | A1 | 3/2006 | Lutz et al. | 606/228 |
| 2010/0159766 | A1 * | 6/2010 | Clough et al. | 442/181 |

* cited by examiner

*Primary Examiner* — Arti Singh-Pandey
(74) *Attorney, Agent, or Firm* — James Arnold, Jr.

(57) ABSTRACT

Unique PTFE fabric structures, and methods for making same, are described which comprise a plurality of PTFE fibers overlapping at intersections, at least a portion of the intersections having PTFE masses which mechanically lock the overlapping PTFE fibers.

21 Claims, 20 Drawing Sheets

PTFE FABRIC ARTICLES AND METHOD OF MAKING SAME

FIELD OF THE INVENTION

The present invention relates to unique PTFE fabric articles. More specifically, novel structures of PTFE and a novel process for preparing the structures are described.

BACKGROUND OF THE INVENTION

The structure of expanded PTFE ("ePTFE") is well known to be characterized by nodes interconnected by fibrils, as taught in U.S. Pat. Nos. 3,953,566 and 4,187,390, to Gore, and which patents have been the foundation for a significant body of work directed to ePTFE materials. The node and fibril character of the ePTFE structure has been modified in many ways since it was first described in these patents. For example, highly expanded materials, as in the case of high strength fibers, can exhibit exceedingly long fibrils and relatively small nodes. Other process conditions can yield articles, for example, with nodes that extend through the thickness of the article.

Surface treatment of ePTFE structure has also been carried out by a variety of techniques in order to modify the ePTFE structure. Okita (U.S. Pat. No. 4,208,745) teaches exposing the outer surface of an ePTFE tube, specifically a vascular prosthesis, to a more severe (i.e., higher) thermal treatment than the inner surface in order to effect a finer structure on the inside than on the outside of the tube. One of ordinary skill in the art will recognize that Okita's process is consistent with prior art amorphous locking processes, the only difference being preferential exposure of the outer surface of the ePTFE structure to greater thermal energy.

Zukowski (U.S. Pat. No. 5,462,781) teaches employing plasma treatment to effect removal of fibrils from the surface of porous ePTFE in order to achieve a structure with free-standing nodes on the surface which are not interconnected by fibrils. No further treatment after the plasma treatment is disclosed or contemplated in the teachings.

Martakos et al. (U.S. Pat. No. 6,573,311) teach plasma glow discharge treatment, which includes plasma etching, of polymer articles at various stages during the polymer resin processing. Martakos et al. distinguish over conventional processes by noting that the prior art techniques operate on finished, fabricated and/or finally processed materials, which are "ineffective at modifying bulk substrate properties, such as porosity and permeability." Martakos et al. teach plasma treating at six possible polymer resin process steps; however, no such treatment with or subsequent to amorphous locking is described or suggested. Again, Martakos et al. is directed to affecting bulk properties such as porosity and/or chemistry quality in the finished articles.

Other means of creating new surfaces on porous PTFE and treating the surface of porous PTFE abound in the prior art. Butters (U.S. Pat. No. 5,296,292) teaches a fishing flyline consisting of a core with a porous PTFE cover that can be modified to improve abrasion resistance. Abrasion resistance of the flyline is improved by modifying the outer cover either through adding a coating of abrasion resistant material or by densifying the porous PTFE cover.

Campbell et al. (U.S. Pat. No. 5,747,128) teach a means of creating regions of high and low bulk density throughout a porous PTFE article. Additionally, Kowligi et al. (U.S. Pat. No. 5,466,509) teach impressing a pattern onto an ePTFE surface, and Seiler et al. (U.S. Pat. No. 4,647,416) teach scoring PTFE tubes during fabrication in order to create external ribs.

Lutz et al. (US 2006/0047311 A1) teach unique PTFE structures comprising islands of PTFE extending from an underlying expanded PTFE structure and methods for making such structures.

None of these documents teaches a uniquely stabilized PTFE fabric structure.

SUMMARY OF THE INVENTION

The present invention is directed to a unique PTFE fabric structure comprising a plurality of PTFE fibers overlapping at intersections, wherein at least a portion of the intersections have PTFE masses which mechanically lock the overlapping PTFE fibers. The term "PTFE" is intended to include PTFE homopolymers and PTFE-containing polymers. By "PTFE fiber" or "fibers" is meant PTFE-containing fibers, including, but not limited to, filled fibers, blends of PTFE fiber and other fiber, various composite structures, fibers with PTFE outer surfaces. As used herein, the terms "structure" and "fabric" may be used interchangeably or together to refer to constructions comprising, but not limited to, knitted PTFE fibers, woven PTFE fibers, nonwoven PTFE fibers, laid scrims of PTFE fibers, etc., and combinations thereof. The term "intersection(s)" refers to any location in a fabric where the PTFE fibers intersect or overlap, such as the cross-over points of the warp and weft fibers in a woven structure, the points where fibers touch in a knit, (e.g., interlocked loops, etc.), and any similar fiber contact points. The term "mass," or "masses," is meant to describe material that mechanically locks the overlapping fibers together at an intersection. By "mechanically lock" or "mechanically locked," is meant at least partially enveloping the fibers and minimizing movement or slippage of the fibers relative to one another at the intersections. The PTFE masses extend from at least one of the intersecting PTFE fibers. The PTFE fibers may be either monofilament fibers or multifilament fibers, or combinations thereof. The multifilament fibers can be combined in a twisted or untwisted configuration. Furthermore, the fibers in some embodiments can comprise expanded PTFE.

The method for forming the inventive PTFE articles comprises the following steps: forming a plurality of PTFE fibers into a structure having intersections of overlapping PTFE fibers; subjecting the structure to a plasma treatment; then subjecting the plasma treated structure to a heat treatment. In the resulting structures, at least a portion of the intersections of overlapping fibers have PTFE masses at said intersections, the PTFE masses extending from at least one of the overlapping, or intersecting, PTFE fibers.

The non-intersecting portions of the fibers may exhibit an appearance as described in US Patent Application Publication US 2006/0047311 A1, the subject matter of which is specifically incorporated herein in its entirety by reference. Specifically, the non-intersecting portions may exhibit islands of PTFE which are attached to and extend from the underlying expanded PTFE structure. These PTFE islands can be seen, upon visual inspection, to be raised above the expanded PTFE structures. The presence of PTFE in the islands can be determined by spectroscopic or other suitable analytical means. By "raised" is meant that when the article is viewed in cross-section, such as in a photomicrograph of the article cross-section, the islands are seen to rise above the baseline defined by the outer surface of the underlying node-fibril structure by a length, "h."

In an alternative embodiment of the invention, one or more filler materials may be incorporated into or with the PTFE structures. For example, it is possible to coat and/or impregnate one or more materials onto and/or into the PTFE fabrics and/or individual fibers of the fabrics of the present invention. In one embodiment of such a structure, an ionomer material may be incorporated with the PTFE fabric, which provides reinforcement, for use in electrolytic and other electrochemical (e.g., chlor-alkali) applications. Alternatively, organic fillers (e.g., polymers) and inorganic fillers may be incorporated with the PTFE fabrics of the invention. Alternatively, the PTFE fabrics may be incorporated as one or more layers of multi-layered structures.

The unique character of the present articles and processes enable the formation of improved products in a variety of commercial applications. For example, PTFE structures of the present invention can exhibit improved performance in such diverse product areas as chlor-alkali membranes, acoustic membranes, filtration media, medical products (including but not limited to implantable medical devices), and other areas where the unique characteristics of these materials can be exploited. PTFE articles of the present invention configured in membrane, tube, sheet, and other shaped geometries and forms can also provide unique benefits in finished products.

Articles of the present invention are particularly useful wherever fray resistance of the fabric is desired. Such articles have even greater value where the properties of PTFE and/or ePTFE are required.

These and other unique embodiments and features of the present invention will be described in more detail herein.

DETAILED DESCRIPTION OF THE FIGURES

The operation of the present invention should become apparent from the following description when considered in conjunction with the accompanying drawings, in which:

FIGS. 1 and 2 are scanning electron photomicrographs (SEMs) at 100× and 250× magnifications, respectively, of the surface of the article made in Example 1a.

FIGS. 3 and 4 are SEMs at 250× and 500× magnifications, respectively, of the cross-section of the article made in Example 1a.

FIGS. 28, 29, 30, and 31 are SEMs at 25×, 100×, 100× and 250× magnifications, respectively, of the surface of the article made in Example 1a after being subjected to the fray resistance via fiber removal test.

Figure 32:
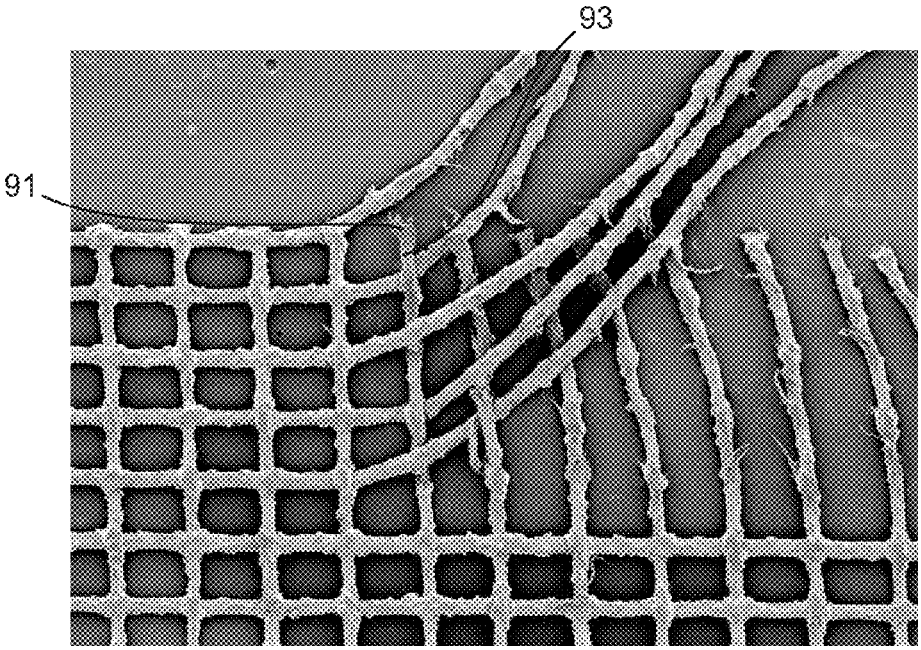
Figure 33:
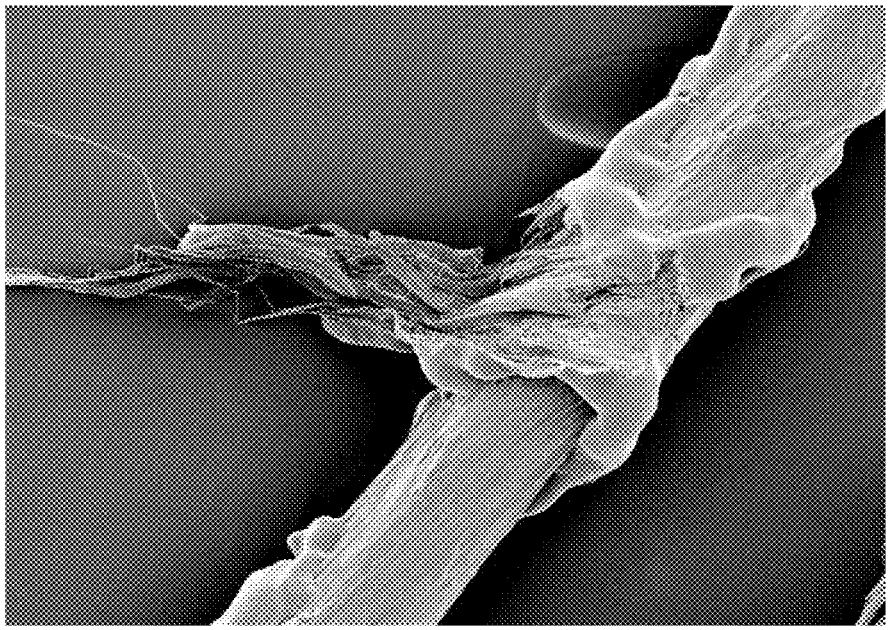

FIGS. 32 and 33 are SEMs at 25× and 250× magnifications, respectively, of the surface of the article made in Example 1b after being subjected to the fray resistance via fiber removal test.

Figure 34:
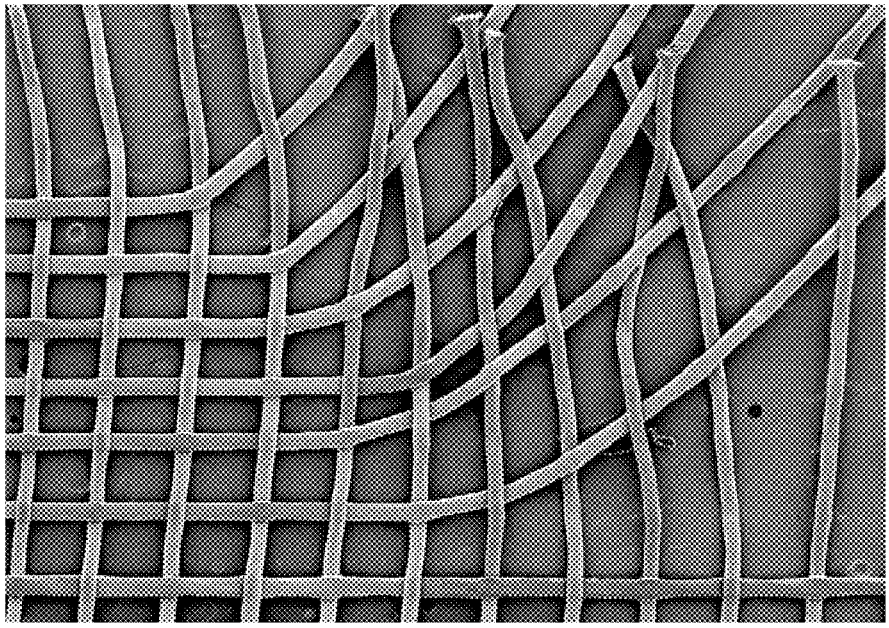
Figure 35:
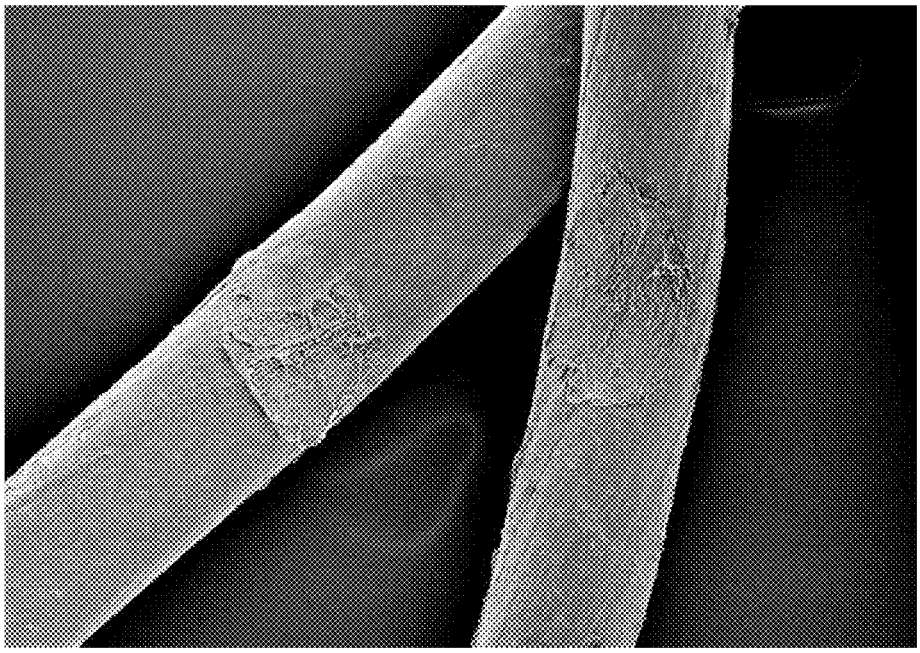

FIGS. 34 and 35 are SEMs at 25× and 250× magnifications, respectively, of the surface of the article made in Comparative Example A after being subjected to the fiber removal test.

Figure 36:
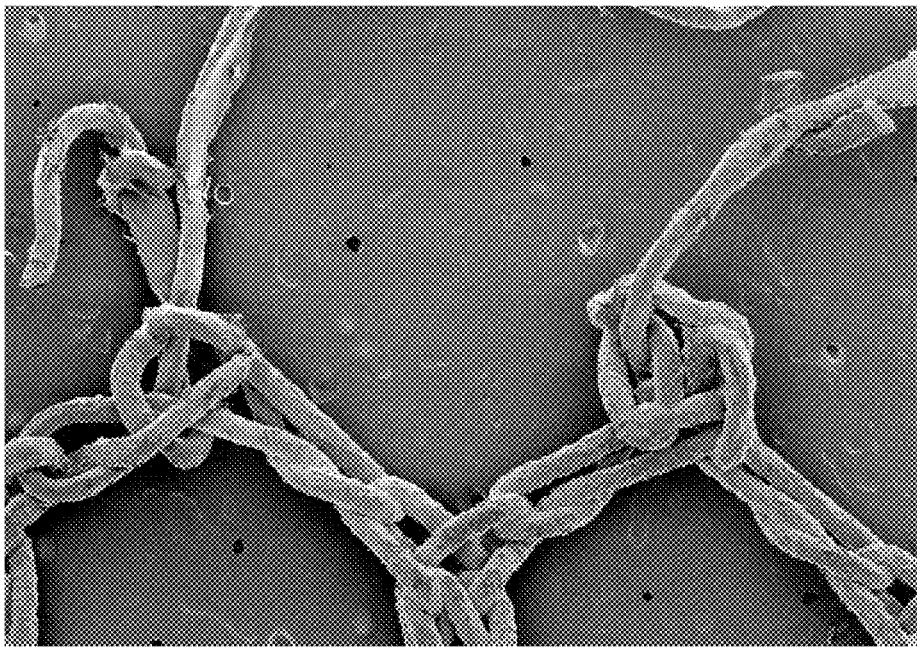
Figure 37:
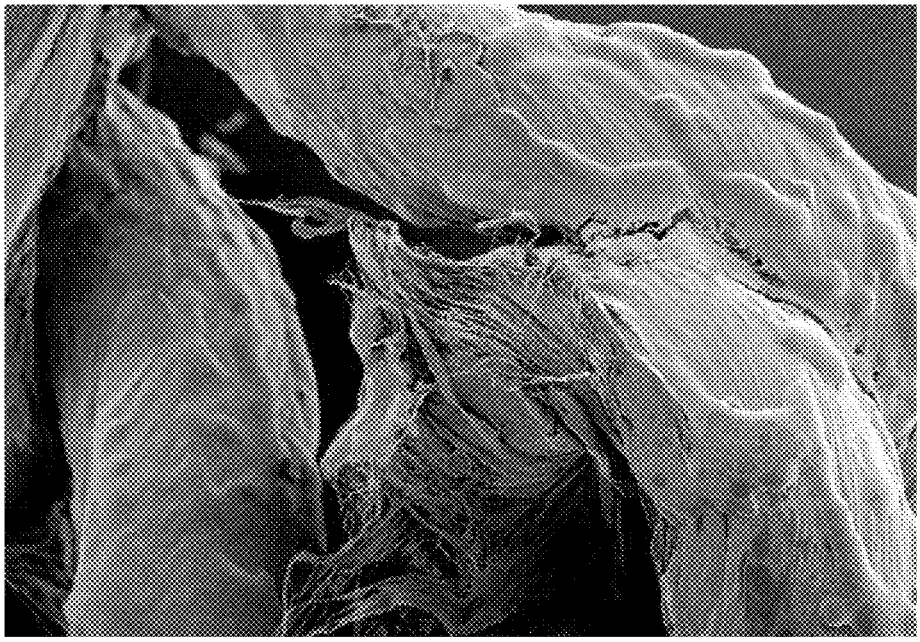

FIGS. 36 and 37 are SEMs at 25× and 250× magnifications, respectively, of the surface of the article made in Example 3 after being subjected to the fiber removal test.

Figure 38:
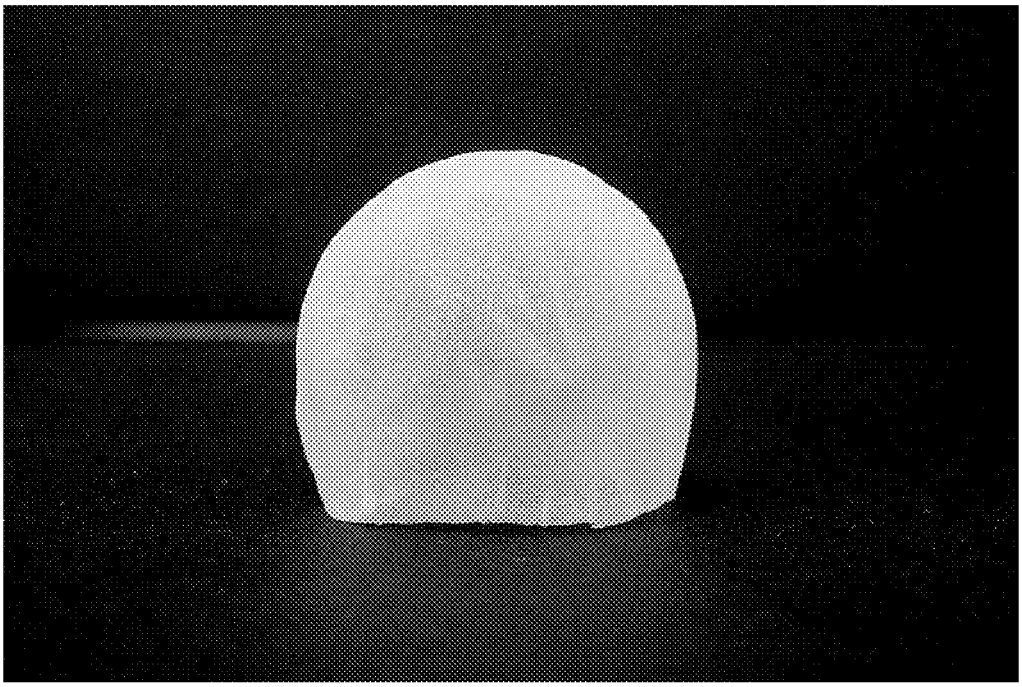

FIG. 38 is a photograph of the shaped article made in Example 9.

Figure 39:
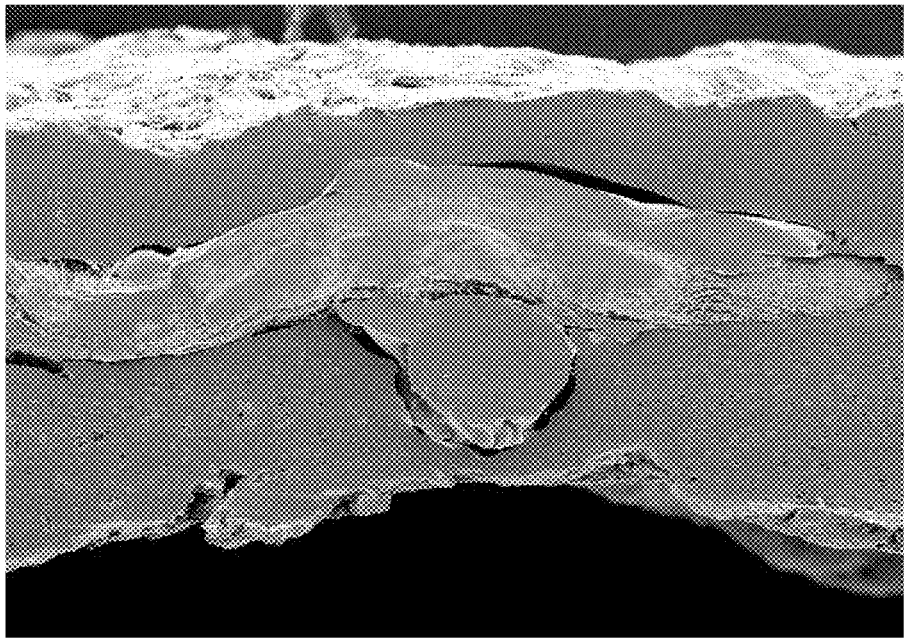

FIG. 39 is an SEM at 250× of the cross-section of the article of Example 10.

Figure 40:
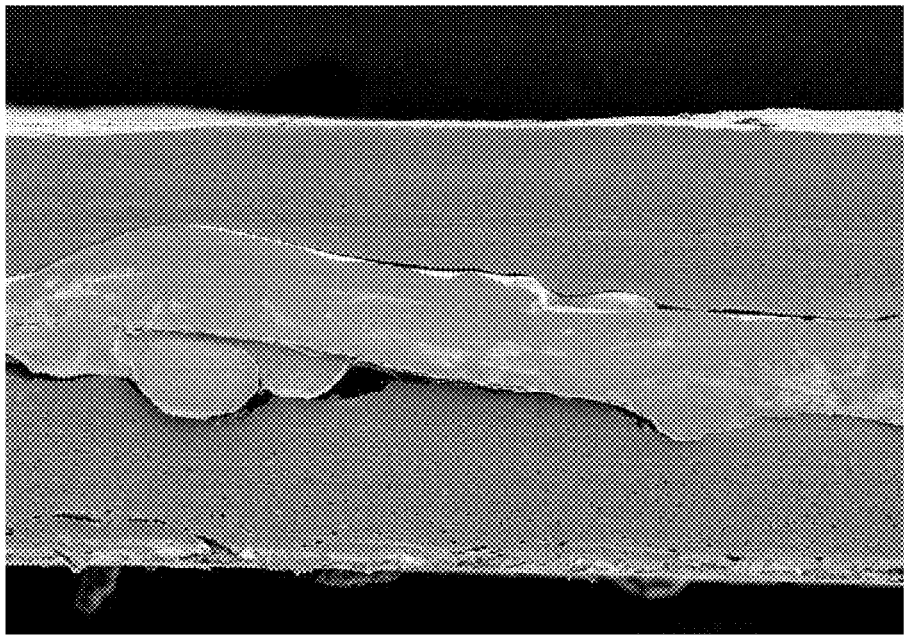

FIG. 40 is an SEM at 250× of the cross-section of the article of Example 11.

DETAILED DESCRIPTION OF THE INVENTION

The PTFE fabric articles of the present invention comprise a plurality of PTFE fibers overlapping at intersections, wherein at least a portion of the intersections have PTFE masses which extend from at least one of the intersecting PTFE fibers and mechanically lock the intersecting, or overlapping, fibers at the intersections. These masses provide the PTFE fabrics with enhanced mechanical stability heretofore unavailable in PTFE fabrics to resist fraying, deformation, etc., and embodiments of the invention may be constructed in a vast array of types and shapes of articles. For example, alternative embodiments of the invention may be constructed incorporating fibers in geometries including, but not limited to, twisted, round, flat and towed fibers, whether in monofilament or multifilament configurations. Additionally, fabrics of the invention may be in the form of sheets, tubes, elongated articles, and other alternative three-dimensionally shaped embodiments. Further, one or more filler materials may be incorporated into or with the PTFE structures. Alternatively, the PTFE fabrics may be incorporated as one or more layers of multi-layered structures.

The unique process of the present invention comprises first forming a precursor PTFE fabric with overlapping PTFE fibers at intersections, whether in the form of one or more woven, knitted, non-woven, laid scrim construction, or some combination thereof; subjecting the precursor PTFE fabric or structure to a high-energy surface treatment; then following with a heating step to achieve the unique PTFE structures with PTFE masses extending from one or more of the underlying intersecting fibers at the fiber intersections. Additionally, the non-intersecting portions may exhibit islands of PTFE which are attached to and extend from the underlying expanded PTFE structure. Solely for convenience, the term "plasma treatment" will be used to refer to any high-energy surface treatment, such as but not limited to glow discharge plasma, corona, ion beam, and the like. It should be recognized that treatment times, temperatures and other processing conditions may be varied to achieve a range of PTFE masses and PTFE island sizes and appearances. For example, in one embodiment, the PTFE fabric can be plasma etched in an argon gas or other suitable environment, followed by a heat treating step. Neither heat treating the PTFE structure alone nor plasma treating alone without subsequent heat treating results in articles of the present invention.

The presence of the masses at the intersections can be confirmed by visual means, including but not limited to techniques such as optical and scanning electron microscopy or by any other suitable means. The presence of PTFE in the masses can be determined by spectroscopic or other suitable analytical means. The mechanical stability is manifested by the mechanical locking of the PTFE fibers to one another at the intersections. This enhanced mechanical stability enables articles of the present invention to resist fraying as well as to substantially resist reorientation of the PTFE fibers upon the application of external forces. Mechanical stability is a critical feature in products in which the size and shape of the fiber arrangement of the articles are important to the optimal performance. Such products include those, such as chlor-alkali membranes, wherein the article provides a mechanically stable substrate. Precision woven products and other precision fabric articles also require the mechanical stability afforded by articles of the present invention.

A fiber removal test may be used to demonstrate the enhanced fray resistance of these unique materials. Other mechanical performance enhancements of these unique materials may include, but are not limited to improved dimensional stability, bending, tear and abrasion characteristics. For example, conventional PTFE fabrics, including precursor articles used in the formation of articles of the present invention, are prone to fraying. This problem is exacerbated due to the lubricious nature of PTFE fibers. This may be demonstrated by simply cutting the fabric with a pair of scissors. Alternatively, this phenomenon can be demonstrated, for instance, by inserting a pin between the fibers of a conventional PTFE fabric, near a free edge of the fabric. Minimal force is required to dislodge and remove an intact fiber upon the application of a tensile force as performed in a fiber removal test, described later herein.

When the same procedures are followed with an article of the present invention, when cut with scissors, the inventive structures are virtually free of frayed fibers. When performing a fiber fray test on the inventive materials, significantly more force is required, enough so as to either break fibers or break the bond provided by the mass of PTFE at the crossover points. The fray resistance of articles of the invention can be determined based on a result where either broken fibers are observed and/or the removal of a fiber with remnants of the mass at the crossover points still attached to the fiber are observed.

As noted earlier herein, a wide variety of shapes and forms of structures including, but not limited to, sheets, tubes, elongated articles and other three-dimensional structures can be formed by following the inventive process to provide greater mechanical stability. In one embodiment, the starting PTFE fabric structures may be configured into a desired final three-dimensional shape prior to subjecting them to the plasma and subsequent heating steps. In an alternative embodiment, the starting PTFE fabric structures can be so treated, then manipulated further, as needed, to create the shapes and forms described above.

The portions of PTFE fibers that are not part of intersections may have a microstructure characterized by nodes interconnected by fibrils, and have raised islands comprising PTFE extending from the PTFE fibers. The masses at intersections in articles of the present invention exhibit a characteristic surface appearance, in which the masses typically extend between overlapping fibers. Islands may or may not be connected to masses. The most surprising result, however, is the dramatic increase in mechanical stability of the inventive article afforded by plasma treatment followed by heat treatment when compared to prior art articles subjected only to a heat treatment.

Whereas a variety of PTFE materials can be utilized in the practice of the invention, in embodiments where ePTFE fiber is used, the ePTFE fibers provide the final articles with the enhanced properties attributable to the expanded PTFE, such as increased tensile strength as well as pore size and porosity that can be tailored for the intended end-use of the product. Furthermore, filled ePTFE fibers can be incorporated and used in the practice of the invention.

The present invention will be described further with respect to the non-limiting Examples provided below.

Test Methods

Fray Resistance via Fiber Removal Test

Fine-tipped tweezers were used to pull away one or more fibers from an edge of a fabric sample at an approximately 45 degree angle relative to the fabric surface. Pulling was carried out until the fiber(s) separated from a portion of the fabric, thus creating a frayed edge. The separated fiber(s) were adhered to a double-sided adhesive tape, the other side of which had been previously adhered to a stub. The frayed edge was also adhered to the adhesive tape. The sample was then examined using a scanning electron microscope. Mechanical locking of overlapping fibers can be determined based on an evaluation of scanning electron micrographs, or other suitable magnified examination means, and a positive result is achieved where either broken fibers are observed and/or the removal of a fiber with remnants of the mass at the crossover points still attached to the fiber are observed. The presence of these remnants indicates mechanical locking by the masses at the fiber crossover points in the fabric, i.e., fray resistance. The absence of these remnants demonstrates the lack of mechanical locking at the fiber crossover points in the fabric and, hence, the propensity to fray.

EXAMPLES

Example 1a

Nominal 90 denier ("d") ePTFE round fiber was obtained (part # V112403; W.L. Gore & Associates, Inc., Elkton, Del.) and woven into a structure having the following properties: 31.5 ends/cm in the warp direction by 23.6 picks/cm in the weft direction.

This woven article was plasma treated with an Atmospheric Plasma Treater (model number ML0061-01, Enercon Industries Corp., Menonomee Falls, Wis.) using argon gas.

The process parameters were: argon flow rate of 50 L/min, power source of 2.5 kW, line speed of 3 m/min, 7.6 cm electrode length, 10 passes. The woven plasma treated article was restrained on a pin frame and placed in a forced air oven (model number CW 7780F, Blue M Electric, Watertown, Wis.) set to 350 deg C. for 30 min.

Figure 1:
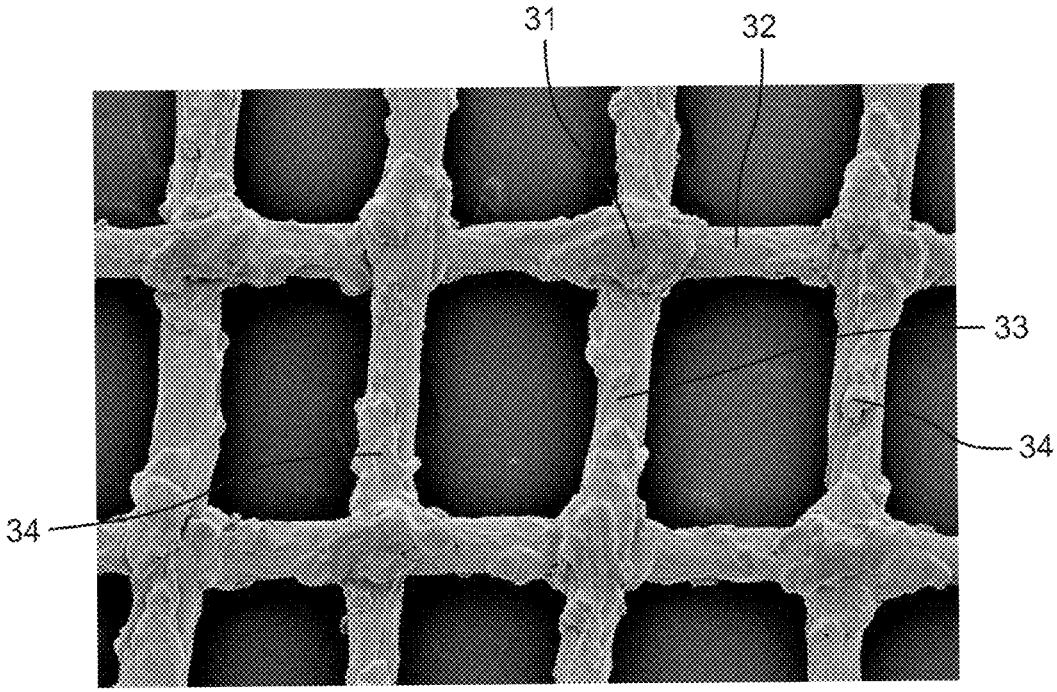
Figure 2:
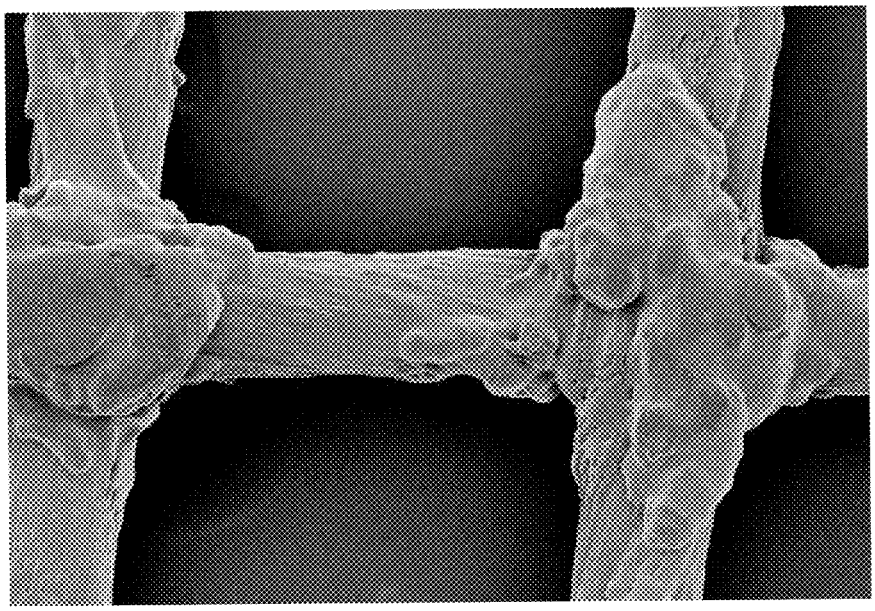
Figure 3:
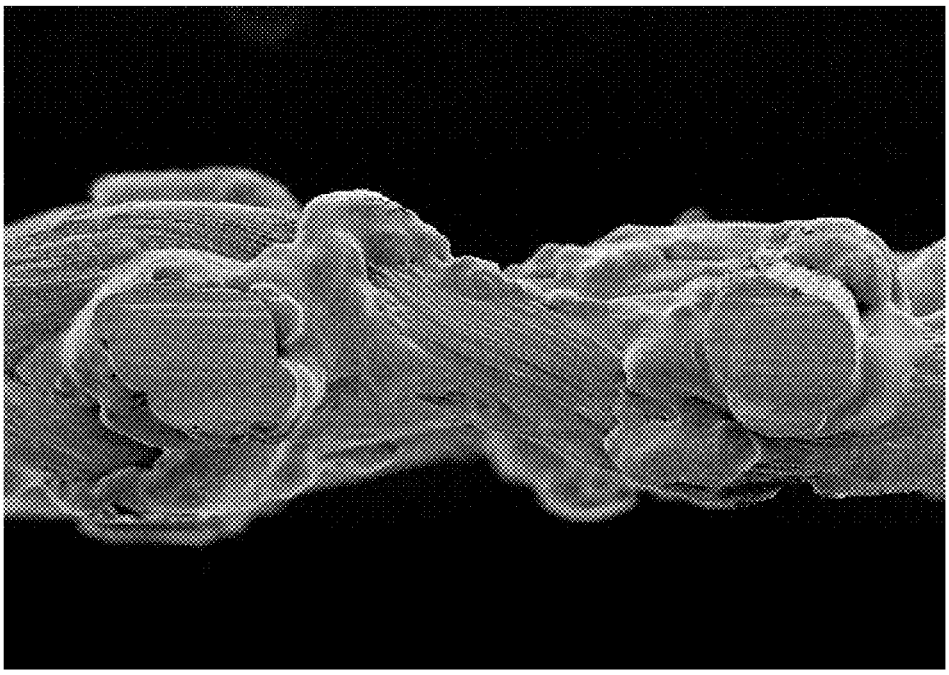
Figure 4:
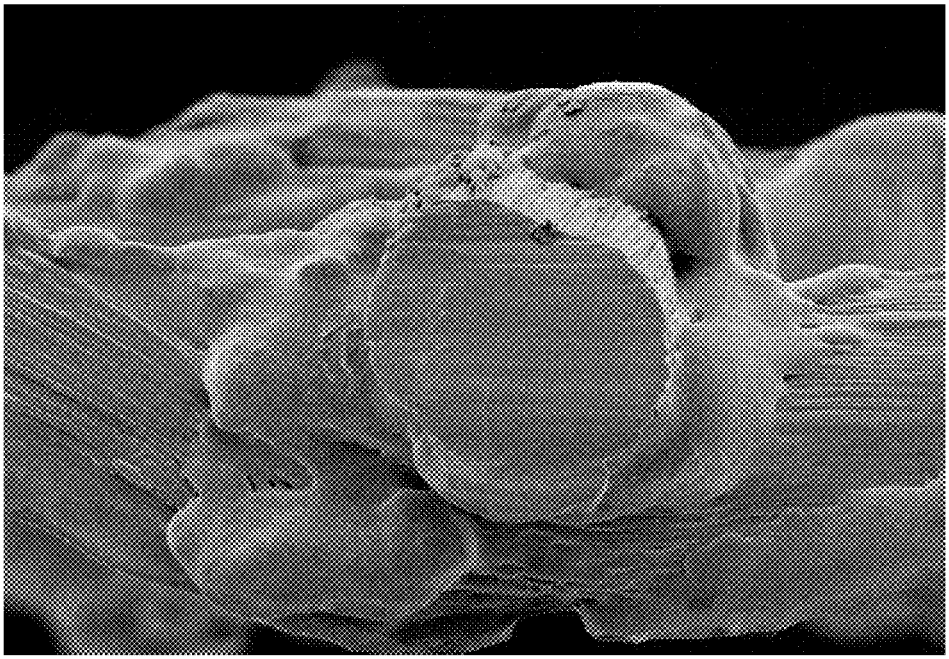

The article was removed from the oven and quenched in water at ambient temperature, then it was examined with a scanning electron microscope. Scanning electron micrographs ("SEMs") of the surface of this article appear in FIGS. 1 and 2 at magnifications of 100× and 250×, respectively. Scanning electron micrographs of the cross-section of this article appear in FIGS. 3 and 4 at magnifications of 250× and 500×, respectively. As shown in FIG. 1, PTFE masses 31 extend from at least one of the intersecting PTFE fibers 32 and 33. PTFE islands 34 are present on the surface of the fibers.

Figure 28:
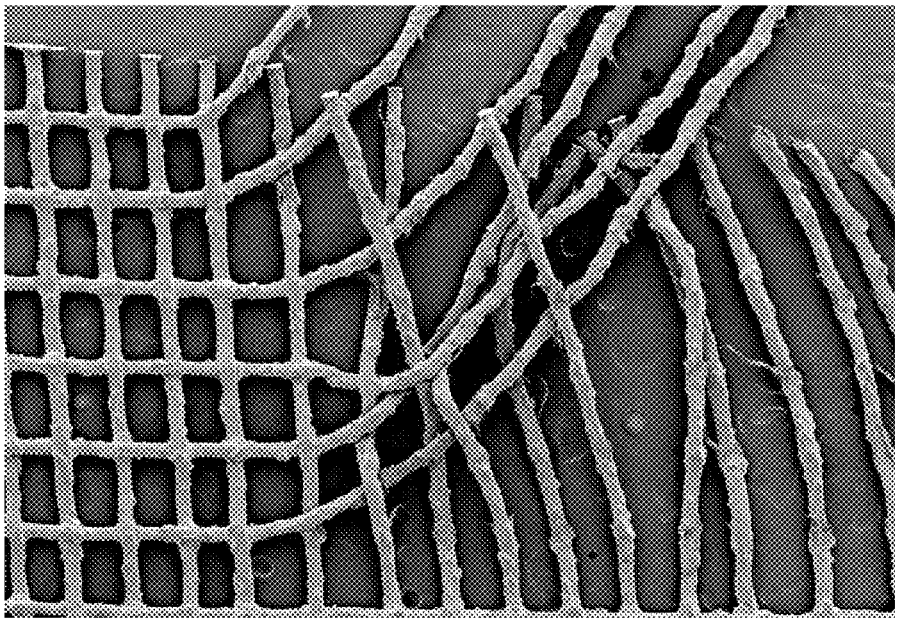
Figure 29:
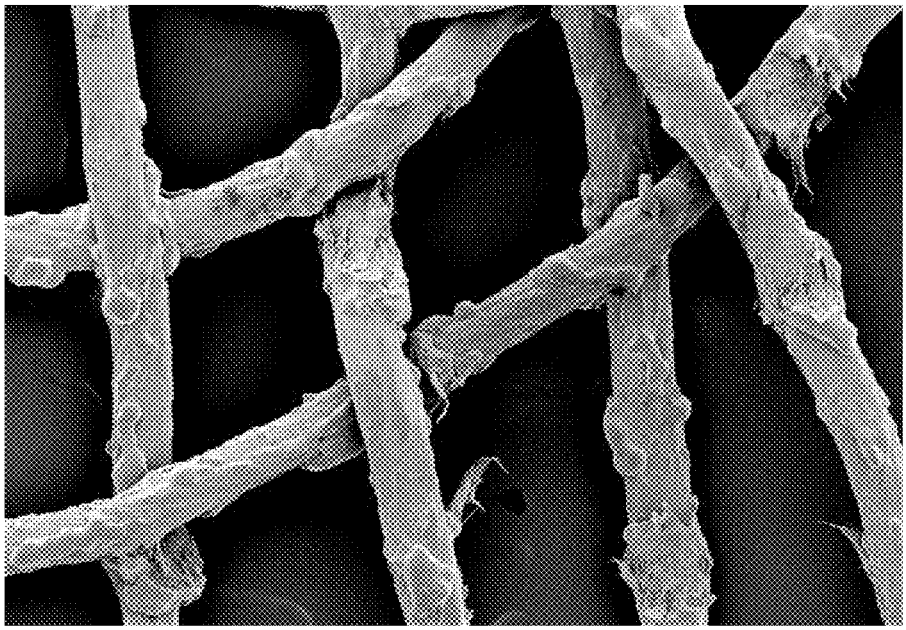
Figure 30:
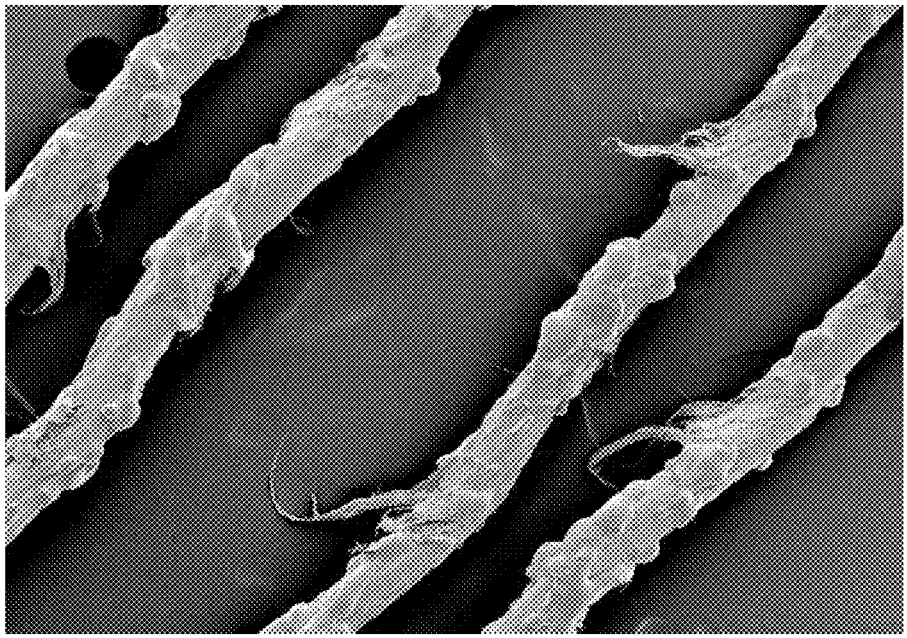
Figure 31:
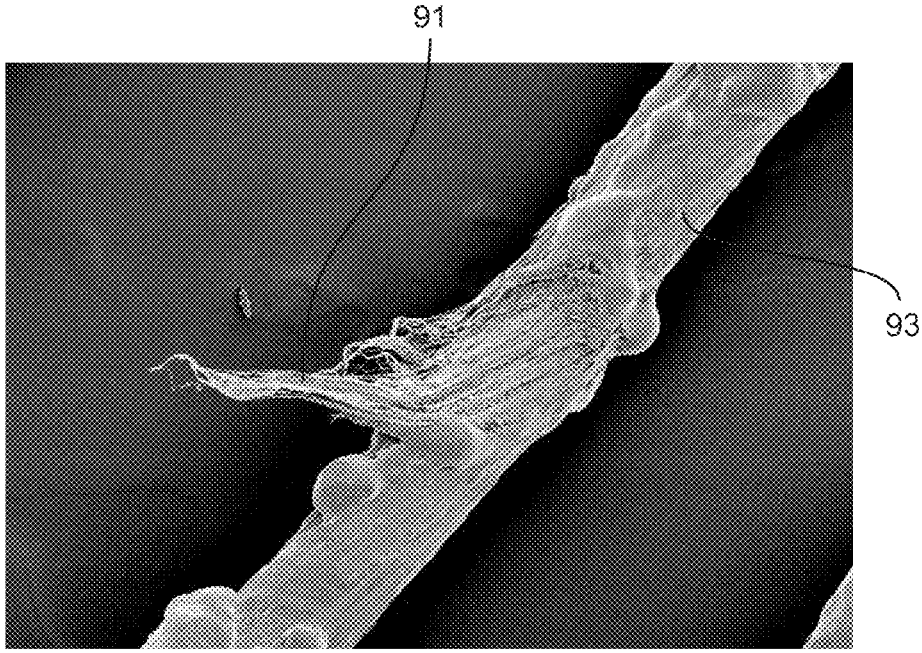

The fray resistance of this structure was demonstrated via the fiber removal test, described above, and results are shown in FIGS. 28-31. Specifically, FIGS. 28 and 29 show SEMs of the fabric of this example at magnifications of 25× and 100×, respectively, after fibers had been teased from the fabric. FIGS. 30 and 31 show SEMs of the fibers of the fabric of this example at magnifications of 100× and 250×, respectively, after the fibers had been removed from the fabric. The hair-like material 91 extending from the fibers 93 had previously comprised a portion of a mass at an intersection of fibers, as is shown in FIG. 32.

The SEMs demonstrate that upon removal of the fibers from the woven article, portions of the PTFE masses at the intersections remained attached to the fibers. That is, the removed fibers exhibit the presence of hair-like material due to the disruption of the masses at the intersections. Accordingly, fray resistance was demonstrated.

Example 1b

Nominal 90d ePTFE round fiber was obtained (part # V112403; W.L. Gore & Associates, Inc., Elkton, Del.), and a woven structure was formed with this fiber having the following properties: 31.5 ends/cm in the warp direction by 23.6 picks/cm in the weft direction.

The woven article was plasma treated with an Atmospheric Plasma Treater (model number ML0061-01, Enercon Industries Corp., Menonomee Falls, Wis.) using argon gas. The process parameters were: argon flow rate of 50 L/min, power source of 2.5 kW, line speed of 3 m/mini 7.6 cm electrode length, 10 passes.

The woven plasma treated article was restrained on a pin frame and placed in a forced air oven (model number CW 7780F, Blue M Electric, Watertown, Wis.) set to 350 deg C. for 15 min. The article was removed from the oven and quenched in water at ambient temperature, then the article was examined with a scanning electron microscope and tested for resistance to fraying (fiber removal) in accordance with the test methods described above.

Figure 5:
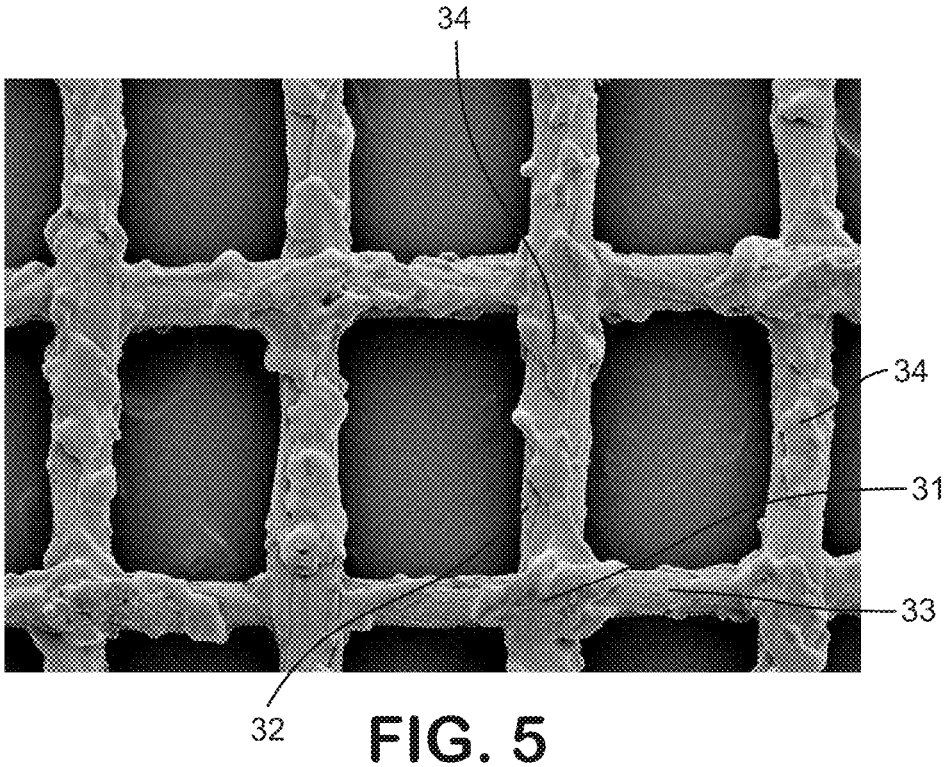
FIG. 5 is an SEM at 100× magnification of the surface of the article made in Example 1b.
Figure 6:
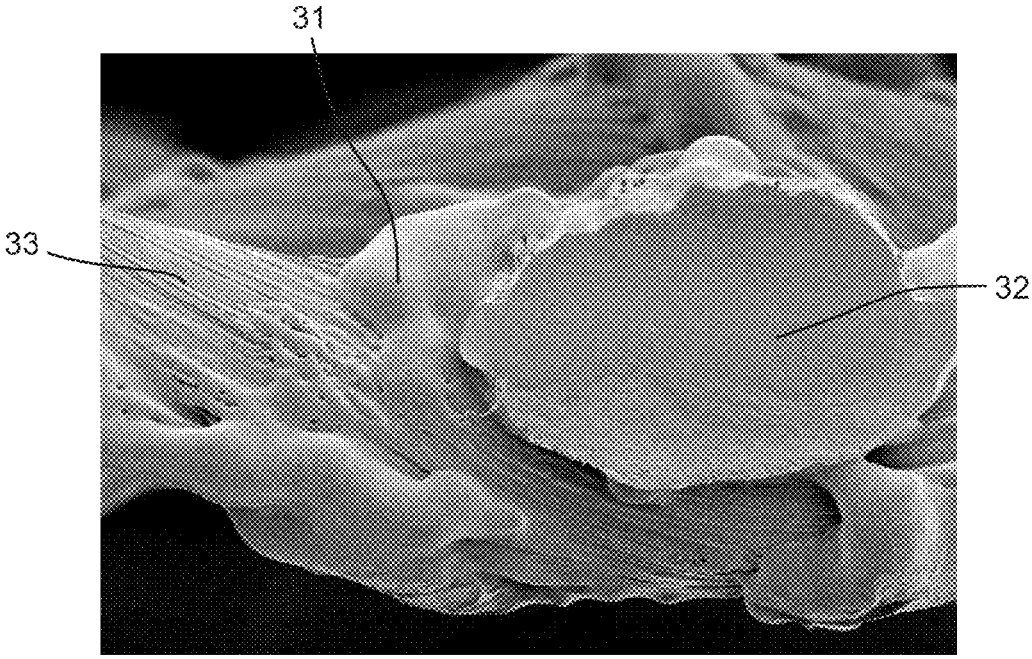
FIG. 6 is an SEM at 500× magnification of the cross-section of the article made in Example 1b.

Scanning electron micrographs of the surface and cross-section of this article appear in FIGS. 5 and 6, respectively, at magnifications of 100× and 500×, respectively.

As shown in FIG. 5, PTFE masses 31 extended from at least one of the intersecting PTFE fibers 32 and 33. PTFE islands 34 are present on the surface of the fibers.

The fray resistance fiber removal test results were as follows. FIG. 32 shows an SEM of the fabric of this example at a magnification of 25× after fibers had been teased from the fabric. FIG. 33 shows an SEM of a fiber of the fabric of this example at a magnification of 250× after this fiber had been teased out of the fabric. The hair-like material extending from the fiber had previously comprised a portion of the mass at an intersection of fibers.

The SEMs demonstrate that upon removal of the fibers from the woven article, portions of the PTFE masses which had been present at the intersections remained attached to the fibers. That is, the removed fibers exhibit the presence of hair-like material due to the disruption of the mass at the intersection. Thus, fray resistance was demonstrated.

Comparative Example A

Nominal 90d ePTFE round fiber was obtained (part # V112403; W.L. Gore & Associates, Inc., Elkton, Del.), and a woven article was formed with this fiber having the following properties: 31.5 ends/cm in the warp direction by 23.6 picks/cm in the weft direction.

The woven article was restrained on a pin frame placed in a forced air oven set to 350 deg C. for 30 min. The article was removed from the oven and quenched in water at ambient temperature. The article was examined with a scanning electron microscope and tested for fraying (fiber removal) in accordance with the test methods described above.

Figure 7:
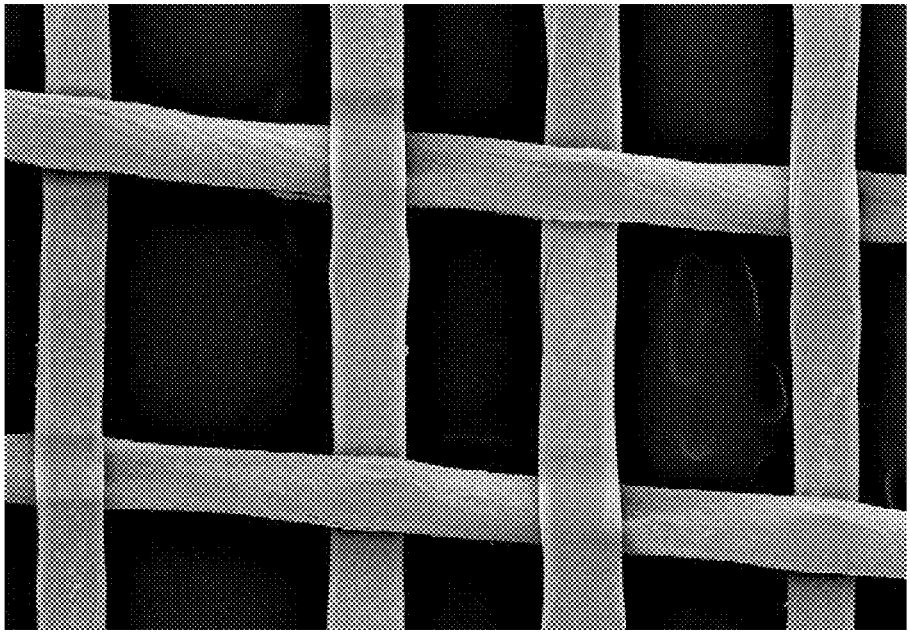
FIGS. 7 and 8 are SEMs at 100× and 250× magnifications, respectively, of the surface of the article made in Comparative Example A.
Figure 8:
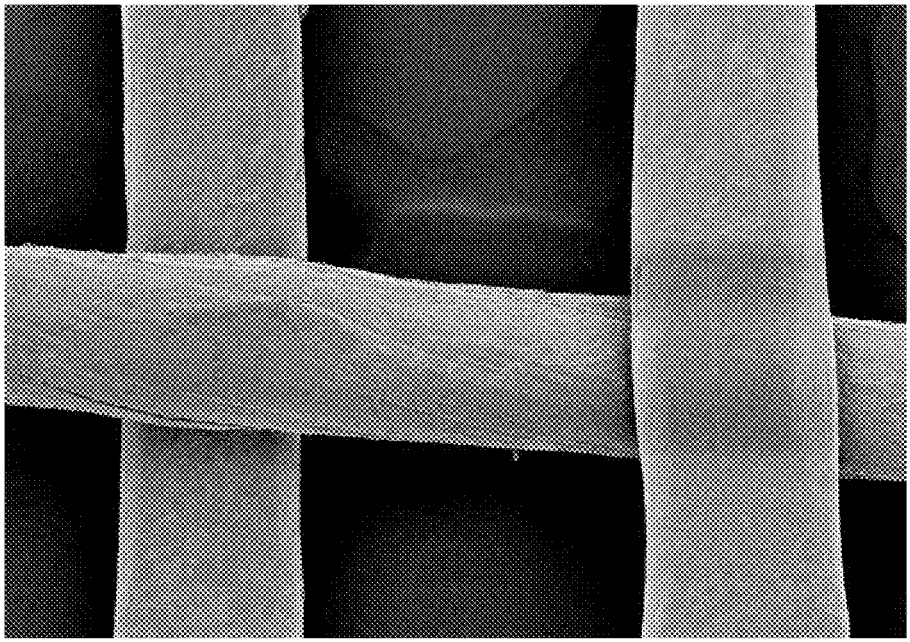
Figure 9:
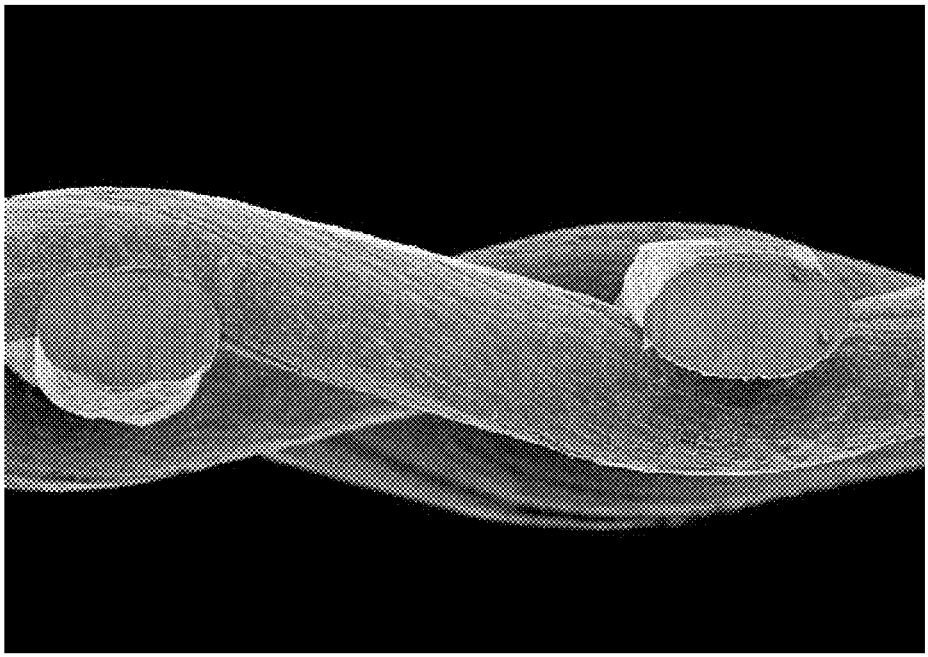
FIGS. 9 and 10 are SEMs at 250× and 500× magnifications, respectively, of the cross-section of the article made in Comparative Example A.
Figure 10:
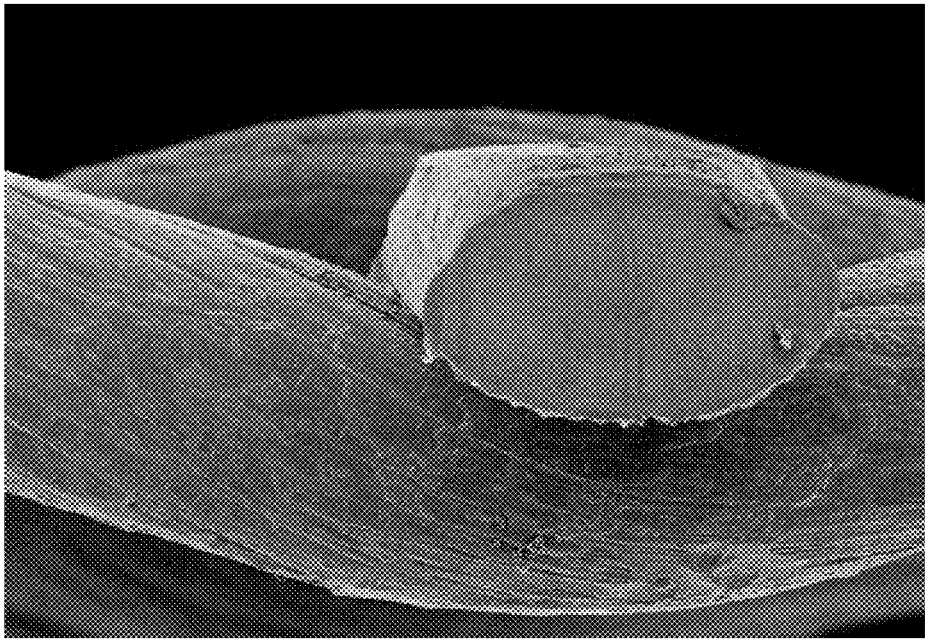

Scanning electron micrographs of the surface of this article appear in FIGS. 7 and 8 at magnifications of 100× and 250×, respectively. Scanning electron micrographs of the cross-section of this article appear in FIGS. 9 and 10 at magnifications of 250× and 500×, respectively. It can be observed from the SEMs that PTFE masses did not extend from the intersecting PTFE fibers and PTFE islands were not present on the surface of the fibers.

The fiber removal test results were as follows. FIG. 34 shows an SEM of the fabric of this comparative sample at a magnification of 25× after fibers had been easily teased out of the fabric. FIG. 35 shows a SEM of fibers of the fabric of this comparative sample at a magnification of 250× after having been teased from the fabric. The SEMs demonstrate that upon removal of the fiber from the woven article, the fibers had no PTFE masses originating from the fiber intersections. That is, the removed fibers exhibit no, presence of hair-like material. Thus, the fabric was determined to lack fray resistance and was easily frayed.

Example 2

Nominal 90d ePTFE round fiber was obtained (part # V112403; W.L. Gore & Associates, Inc., Elkton, Del.), and a woven article was created with this fiber having the following properties: 49.2 ends/cm in the warp direction by 49.2 picks/cm in the weft direction.

The woven article was plasma treated with an Atmospheric Plasma Treater (model number ML0061-01, Enercon Industries Corp., Menomonee Falls, Wis.) using argon gas. The process parameters were: argon flow rate of 50 L/min, power source of 2.5 kW, line speed of 3 m/min, 7.6 cm electrode length, 5 passes.

The woven plasma treated article was restrained on a pin frame and placed in a forced air oven (model number CW 7780F, Blue M Electric, Watertown, Wis.) set to 350 deg C. for 15 min. The article was removed from the oven and quenched in water at ambient temperature.

Figure 11:
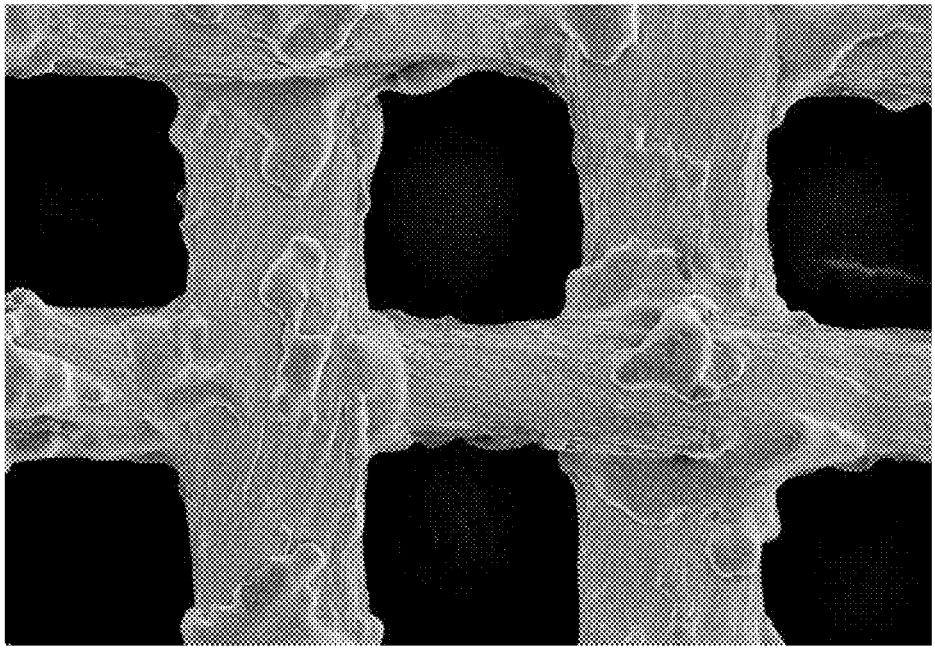
FIG. 11 is an SEM at 250× magnification of the surface of the article made in Example 2.
Figure 12:
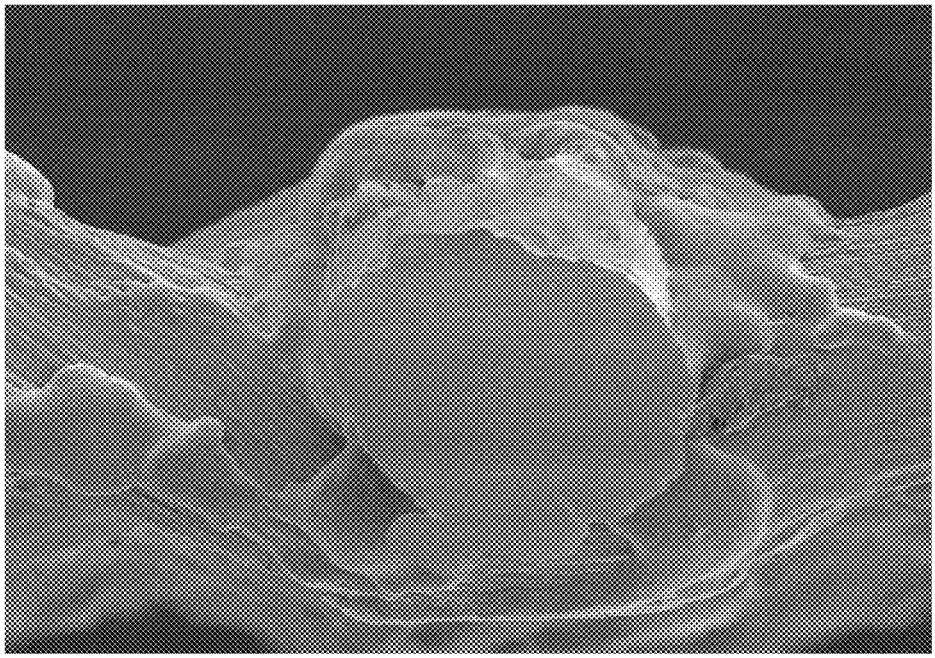
FIG. 12 is an SEM at 500× magnification of the cross-section of the article made in Example 2.

The article was examined with a scanning electron microscope and tested for fray resistance using the fiber removal test described above. Scanning electron micrographs of the surface and cross-section of this article appear in FIGS. 11 and 12, respectively, at magnifications of 250× and 500×, respectively. PTFE masses were observed to extend from at least one of the intersecting PTFE fibers. PTFE islands were also observed on the surface of the fibers.

The fray resistance of the material was tested via the fiber removal test. Upon visual inspection of SEMs of the resulting fibers (not shown) it was observed that portions of the PTFE masses which had been present at the intersections remained attached to the fibers. That is, the removed fibers exhibit the presence of hair-like material due to the disruption of the masses at the intersections. Thus, fray resistance was demonstrated.

Example 3

A nominal 160d, 3.8 g/d, 0.1 mm diameter ePTFE round fiber was obtained and a hexagonal knit ePTFE mesh was formed with this fiber. The knit fabric had the following properties: an areal density of 68 g/m$^2$, 17 courses/cm and 11 wales/cm.

The knitted mesh was plasma treated with an Atmospheric Plasma Treater (model number ML0061-01, Enercon Industries Corp., Menomonee Falls, Wis.) using argon gas. The process parameters were: argon flow rate of 50 L/min, power source of 2.5 kW, line speed of 3 m/min, 7.6 cm electrode length, 5 passes.

The knitted plasma treated article was restrained on a pin frame and placed in a forced air oven (model number CW 7780F, Blue M Electric, Watertown, Wis.) set to 350 deg C. for 30 min. The article was removed from the oven and quenched in water at ambient temperature.

Figure 13:
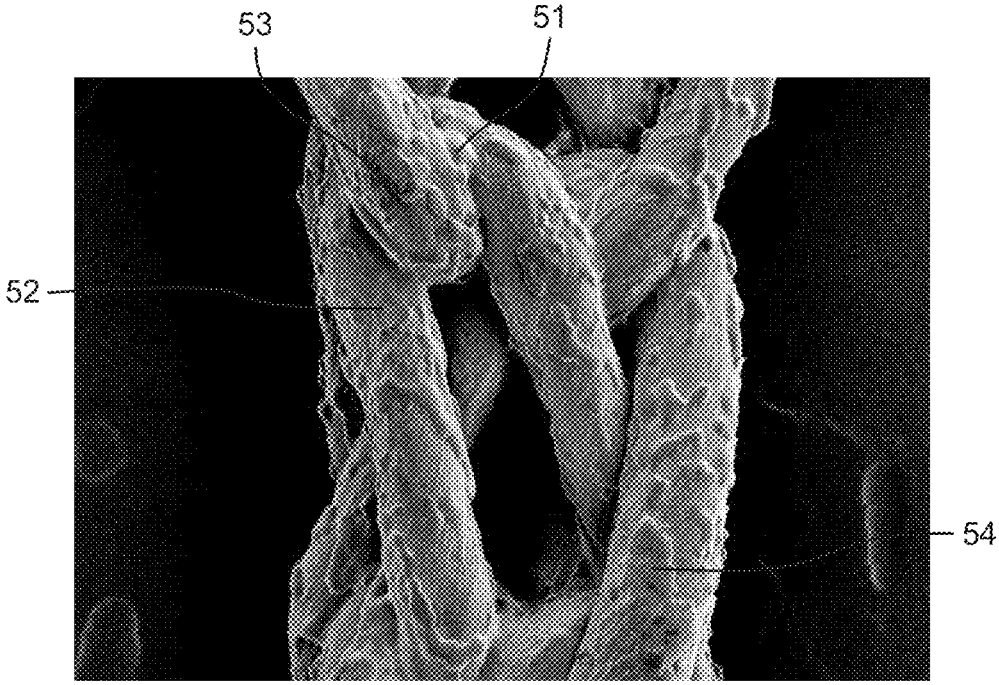
FIG. 13 is an SEM at 100× magnification of the surface of the article made in Example 3.
Figure 14:
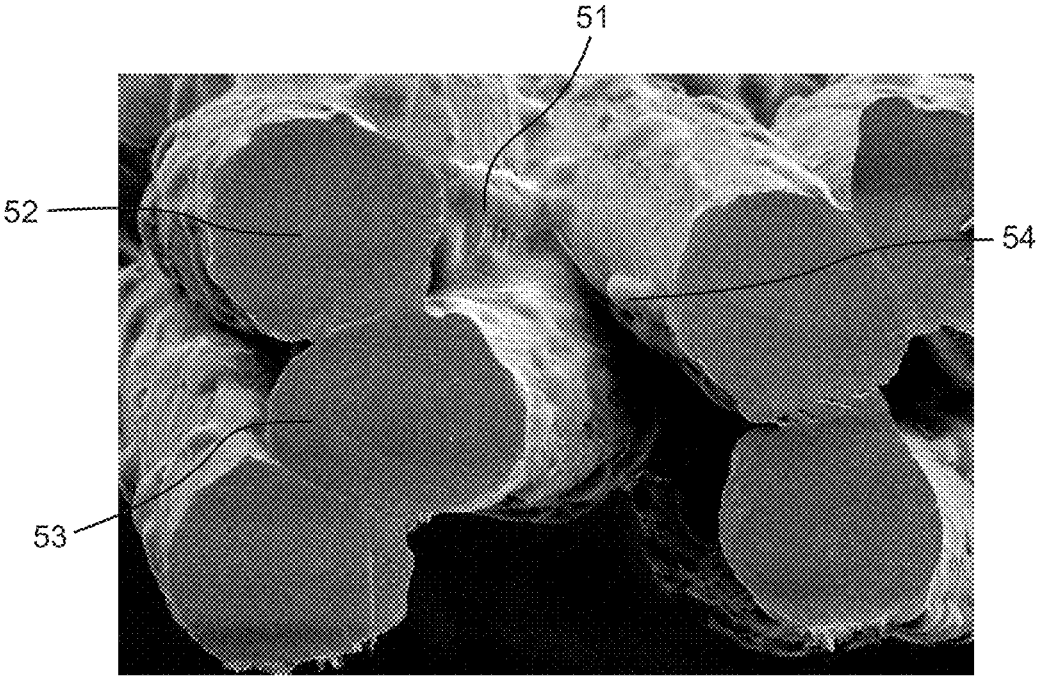
FIG. 14 is an SEM at 250× magnification of the cross-section of the article made in Example 3.

The article was examined with a scanning electron microscope, and scanning electron micrographs of the surface and cross-section of this article appear in FIGS. 13 and 14, respectively, at magnifications of 100× and 250×, respectively. PTFE masses 51 extended from at least one of the intersecting PTFE fibers 52 and 53. PTFE islands 54 were present on the surface of the fibers.

The article was tested for fray resistance in accordance with the fiber removal test method described above. Results were obtained as follows. Specifically, FIG. 36 shows an SEM of the fabric of this example at a magnification of 25× after fibers had been teased from the fabric. FIG. 37 shows an SEM of a fiber of the fabric of this example at a magnification of 250× after performing the Fray Resistance via Fiber Removal Test on the fabric. The hair-like material extending from the fiber had previously comprised a portion of the mass at an intersection of fibers. The SEMs demonstrate that upon removal of the fibers from the knitted article, portions of the PTFE masses from the fiber intersections remained attached to the fibers. Thus, fray resistance was demonstrated.

Comparative Example B

A nominal 160d, 3.8 g/d, 0.1 mm diameter ePTFE round fiber was obtained and a hexagonal knit ePTFE mesh was formed with this fiber. The knit fabric had the following properties: an areal density of 68 g/m$^2$, 17 courses/cm and 11 wales/cm.

The knitted article was restrained on a pin frame and placed in a forced air oven (model number CW 7780F, Blue M Electric, Watertown, Wis.) set to 350 deg C. for 30 min. The article was removed from the oven and quenched in water at ambient temperature.

Figure 15:
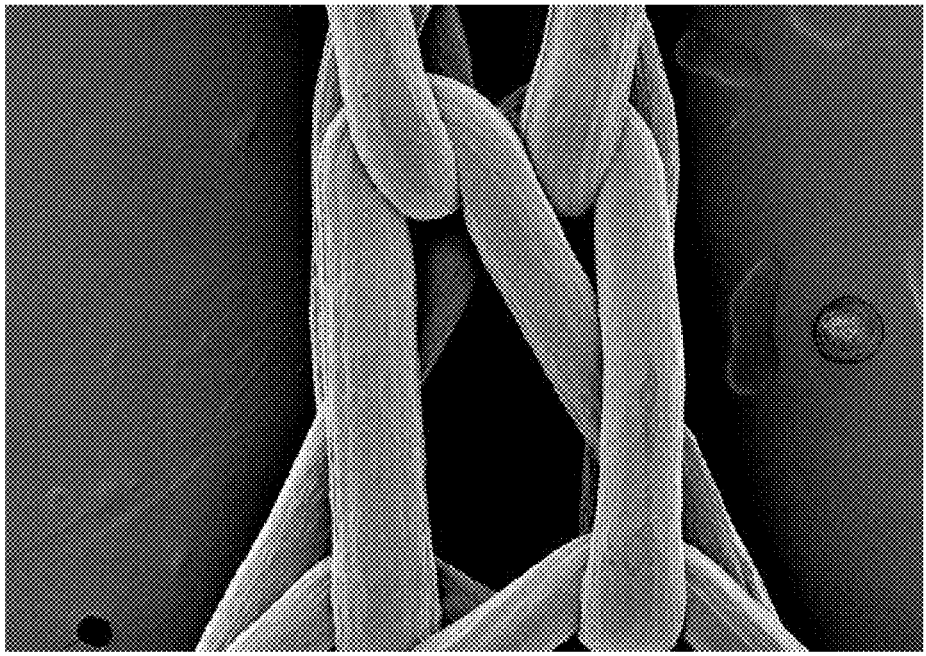
FIG. 15 is an SEM at 100× magnification of the surface of the article made in Comparative Example B.
Figure 16:
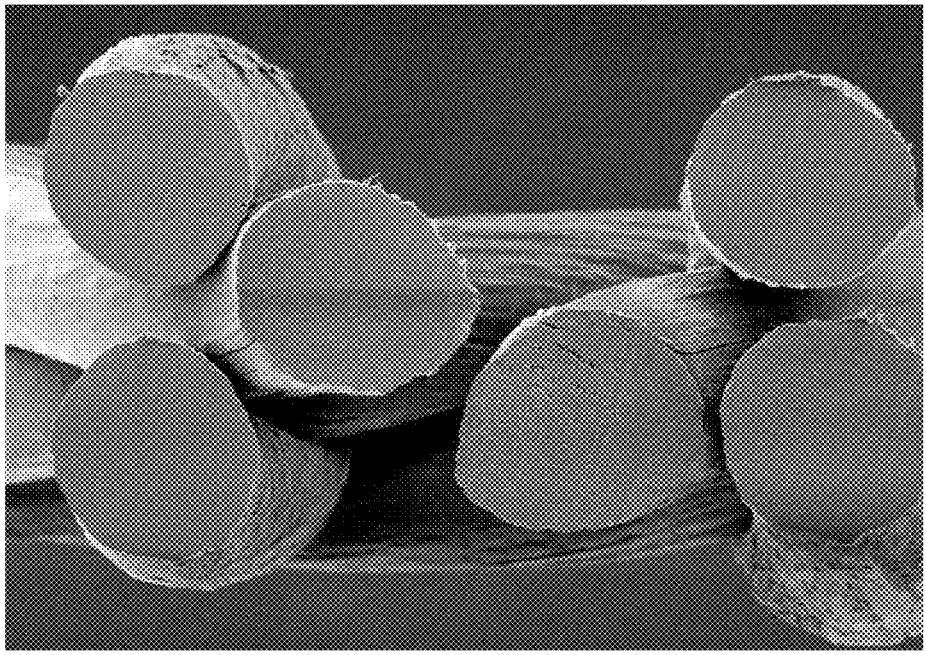
FIG. 16 is an SEM at 250× magnification of the cross-section of the article made in Comparative Example B.

Scanning electron micrographs of the surface and cross-section of this article appear in FIGS. 15 and 16, respectively, at magnifications of 100× and 250×, respectively. PTFE masses did not extend from the intersecting PTFE fibers. Also, PTFE islands were not present on the surface of the fibers.

Example 4

Nominal 400d twisted ePTFE flat fiber was obtained (part # V11828; W.L. Gore & Associates, Inc., Elkton, Del.) and twisted at between 3.9 and 4.7 twists per cm. A woven article was created with this fiber having the following properties: 13.8 ends/cm in the warp direction by 11.8 picks/cm in the weft direction.

The woven article was plasma treated with an Atmospheric Plasma Treater (model number ML0061-01, Enercon Industries Corp., Menomonee Falls, Wis.) using argon gas. The process parameters were: argon flow rate of 50 L/min, power source of 2.5 kW, line speed of 3 m/min, 7.6 cm electrode length, 5 passes.

The woven plasma treated article was restrained on a pin frame and placed in a forced air oven (model number CW 7780F, Blue M Electric, Watertown, Wis.) set to 350 deg C. for 45 min. The article was removed from the oven and quenched in water at ambient temperature.

Figure 17:
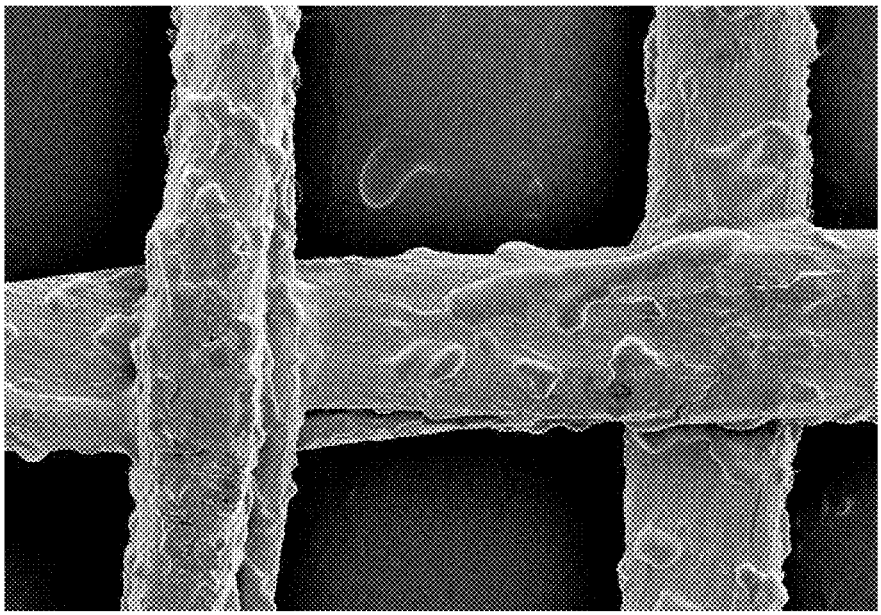
FIG. 17 is an SEM at 100× magnification of the surface of the article made in Example 4.
Figure 18:
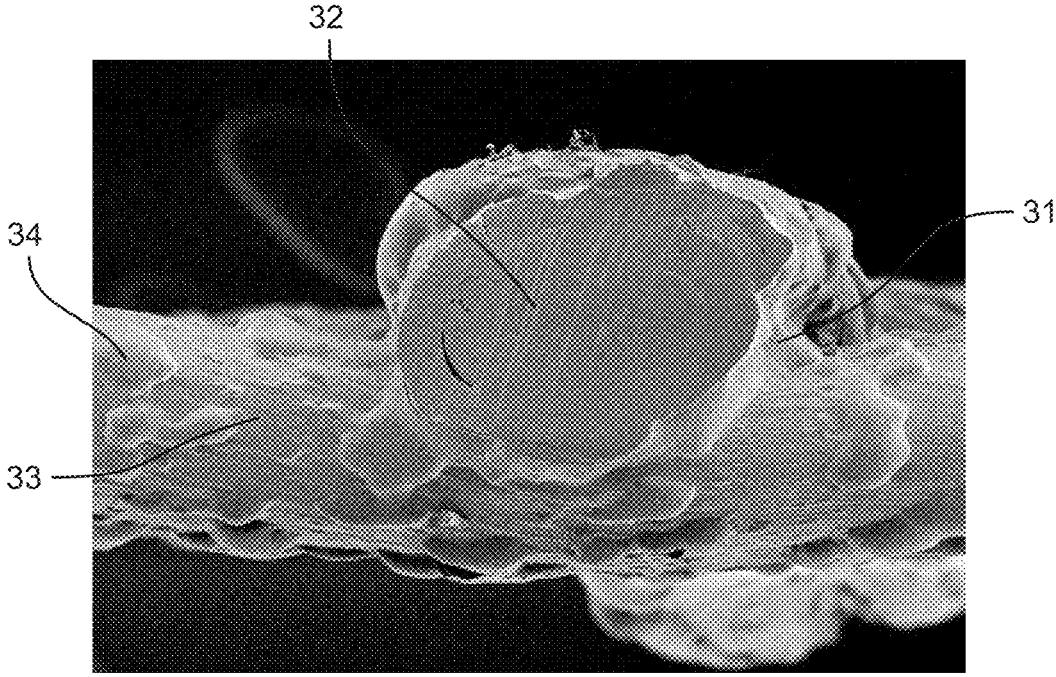
FIG. 18 is an SEM at 250× magnification of the cross-section of the article made in Example 4.

The article was examined with a scanning electron microscope. Scanning electron micrographs of the surface and cross-section of this article appear in FIGS. 17 and 18, respectively, at magnifications of 100× and 250×, respectively. PTFE masses 31 extended from at least one of the intersecting PTFE fibers 32, 33. PTFE islands 34 were present on the surface of the fibers.

Comparative Example C

Nominal 400d twisted ePTFE flat fiber was obtained (part # V111828; W.L. Gore & Associates, Inc., Elkton, Del.) and twisted at between 3.9 and 4.7 twists per cm. A woven article was created with this fiber having the following properties: 13.8 ends/cm in the warp direction by 11.8 picks/cm in the weft direction.

The woven article was restrained on a pin frame and placed in a forced air oven (model number CW 7780F, Blue M Electric, Watertown, Wis.) set to 350 deg C. for 45 min. The article was removed from the oven and quenched in water at ambient temperature.

Figure 19:
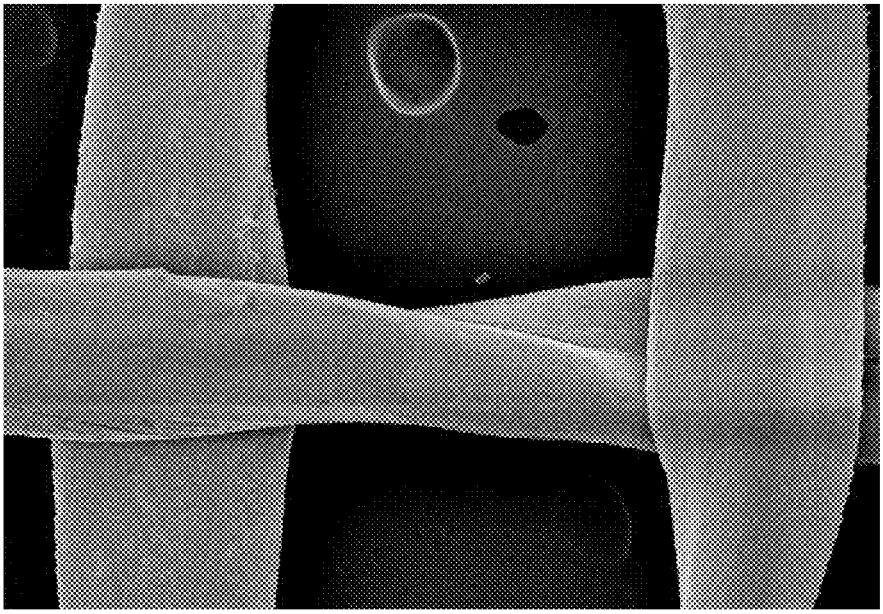
FIG. 19 is an SEM at 100× magnification of the surface of the article made in Comparative Example C.
Figure 20:
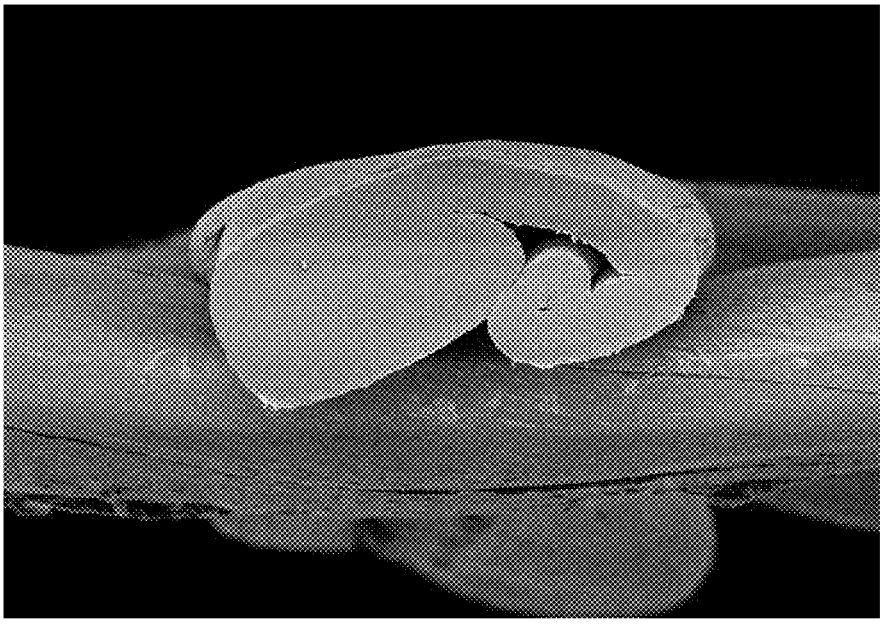
FIG. 20 is an SEM at 250× magnification of the cross-section of the article made in Comparative Example C.

The article was examined with a scanning electron microscope. Scanning electron micrographs of the surface and cross-section of this article appear in FIGS. 19 and 20, respectively, at magnifications of 100× and 250×, respectively. It was observed that PTFE masses did not exist at the intersections of the PTFE fibers. Also, no PTFE islands were present on the surface of the fibers.

Example 5

A tightly woven fabric was obtained having the following properties: 453d spun matrix PTFE fiber (Toray Fluorofibers [America], Inc., Decatur, Ala.), fiber, 31.3 ends/cm in the warp direction by 26.7 ends/cm in the weft direction.

The fabric was plasma treated with an Atmospheric Plasma Treater (model number ML0061-01, Enercon Industries Corp., Menomonee Falls, Wis.) using argon gas. The process parameters were: argon flow rate of 50 L/min, power source of 2.5 kW, line speed of 3 m/min, 7.6 cm electrode length, 10 passes.

The woven plasma treated article was restrained on a pin frame and placed in a forced air oven (model number CW 7780F, Blue M Electric, Watertown, Wis.) set to 350 deg C.

for 15 min. The article was removed from the oven and quenched in water at ambient temperature.

Figure 21:
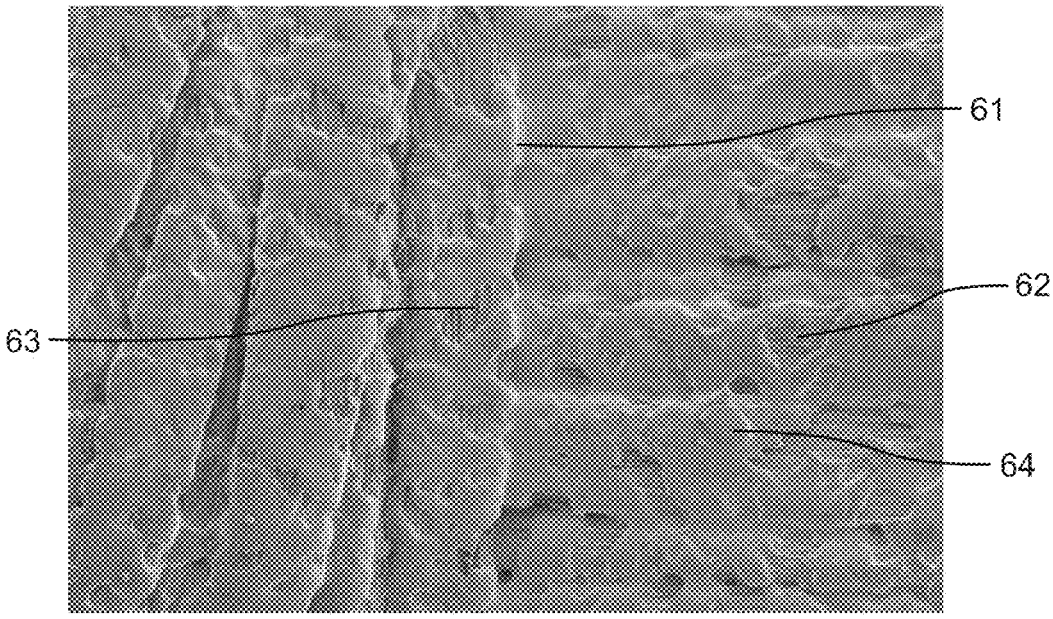
FIG. 21 is an SEM at 500× magnification of the surface of the article made in Example 5.
Figure 22:
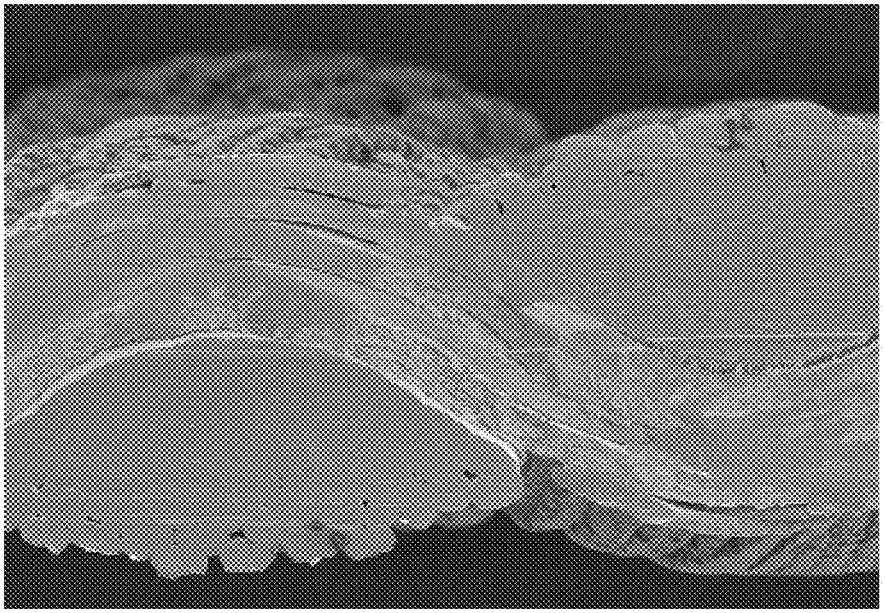
FIG. 22 is an SEM at 250× magnification of the cross-section of the article made in Example 5.

The article was examined with a scanning electron microscope. Scanning electron micrographs of the surface and cross-section of this article appear in FIGS. 21 and 22, respectively, at magnifications of 500× and 250×, respectively. PTFE masses 61 were observed extended from at least one of the intersecting PTFE fibers 62, 63. PTFE islands 64 were present on the surface of the fibers.

Comparative Example D

A tightly woven fabric was obtained having the following properties: 453d spun matrix PTFE fiber (Toray Fluorofibers [America], Inc., Decatur, Ala.), 31.3 ends/cm in the warp direction by 26.7 ends/cm in the weft direction.

The woven fabric was restrained on a pin frame and placed in a forced air oven (model number CW 7780F, Blue M Electric, Watertown, Wis.) set to 350 deg C. for 15 min. The article was removed from the oven and quenched in water at ambient temperature.

Figure 23:
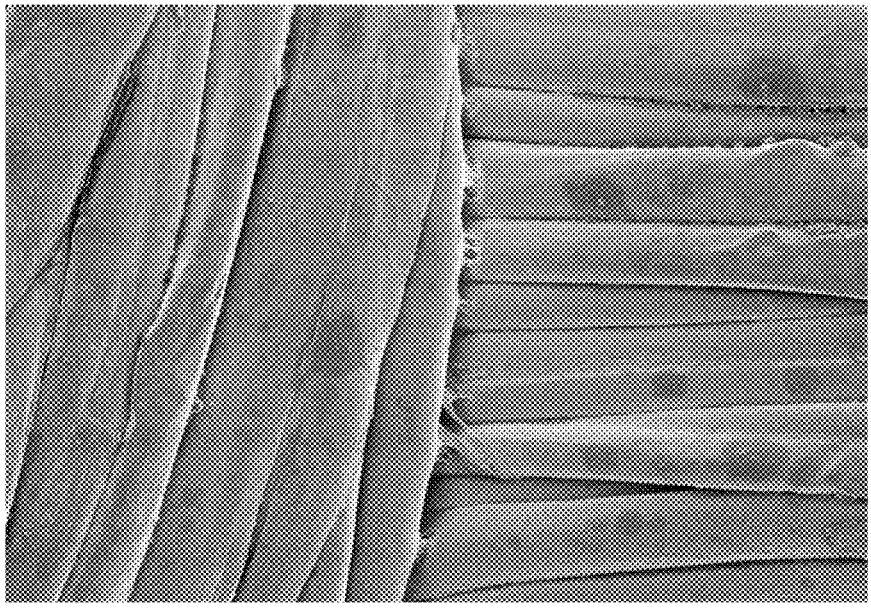
FIG. 23 is an SEM at 500× magnification of the surface of the article made in Comparative Example D.
Figure 24:
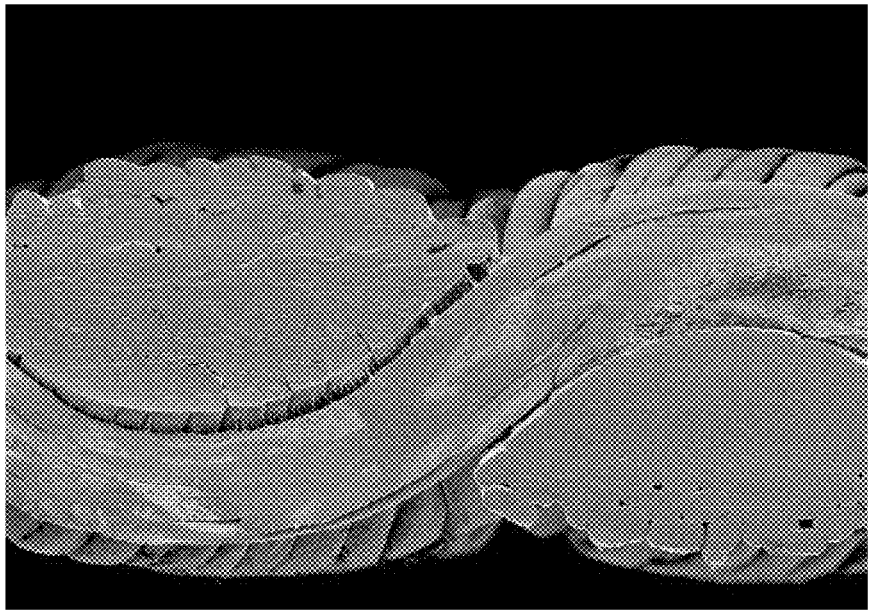
FIG. 24 is an SEM at 250× magnification of the cross-section of the article made in Comparative Example D.

The article was examined with a scanning electron microscope. Scanning electron micrographs of the surface and cross-section of this article appear in FIGS. 23 and 24, respectively, at magnifications of 500× and 250×, respectively. It was observed that no PTFE masses extended from the intersecting PTFE fibers and no PTFE islands were present on the surface of the fibers.

Example 6

Nominal 400d multifilament ePTFE fiber was obtained (part # 5816527; W.L. Gore & Associates, Inc., Elkton, Del.), and a woven article was created with this fiber having the following properties: 11.8 ends/cm in the warp direction by 11.9 picks/cm in the weft direction.

The woven article was plasma treated with an Atmospheric Plasma Treater (model number ML0061-01, Enercon Industries Corp., Menomonee Falls, Wis.) using argon gas. The process parameters were: argon flow rate of 50 L/min, power source of 2.5 kW, line speed of 3 m/min, 7.6 cm electrode length, 5 passes.

The woven plasma treated article was restrained on a pin frame and placed in a forced air oven (model number CW 7780F, Blue M Electric, Watertown, Wis.) set to 350 deg C. for 40 min. The article was removed from the oven and quenched in water at ambient temperature.

Figure 25:
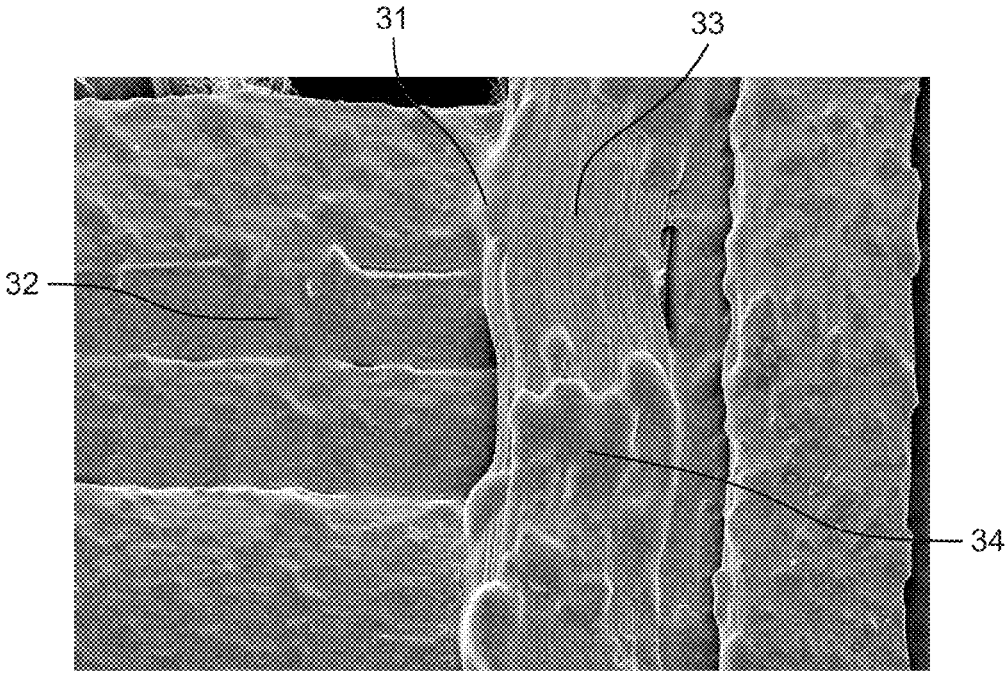
FIG. 25 is an SEM at 500× magnification of the surface of the article made in Example 6.

The article was examined with a scanning electron microscope. A scanning electron micrograph of the surface of this article appears in FIG. 25, at a magnification of 500×. PTFE masses 31 were observed extended from at least one of the intersecting PTFE fibers 32, 33, and PTFE islands 34 were observed on the surface of the fibers.

Comparative Example E

Nominal 400d multifilament ePTFE fiber was obtained (part # 5816527; W.L. Gore & Associates, Inc., Elkton, Del.), and a woven article was formed with this fiber having the following properties: 11.8 ends/cm in the warp direction by 11.9 picks/cm in the weft direction.

The woven article was restrained on a pin frame and placed in a forced air oven (model number CW 7780F, Blue M Electric, Watertown, Wis.) set to 350 deg C. for 40 min. The article was removed from the oven and quenched in water at ambient temperature.

Figure 26:
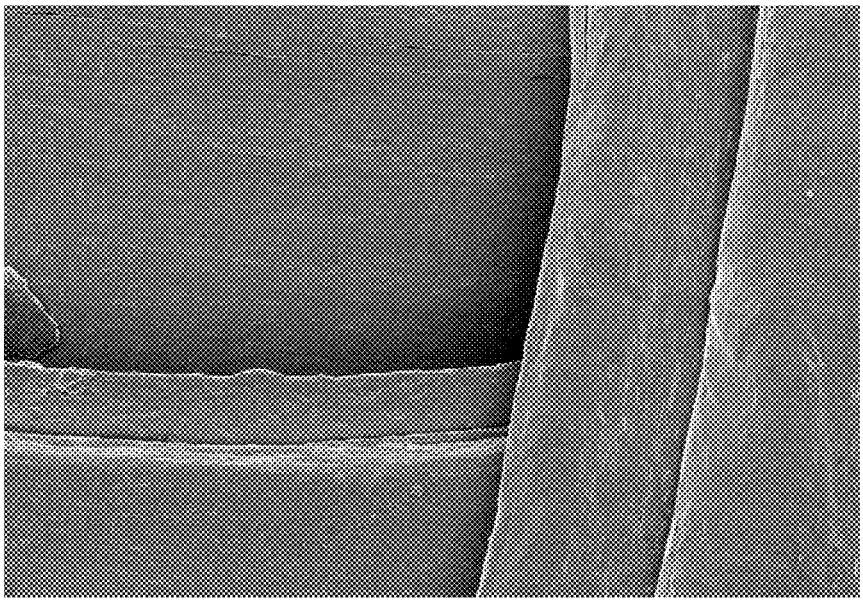
FIG. 26 is an SEM at 500× magnification of the surface of the article made in Comparative Example E.

The article was examined with a scanning electron microscope. A scanning electron micrograph of the surface of this article appears in FIGS. 26, at a magnification of 500×. No PTFE masses were observed at the intersecting PTFE fibers, and no PTFE islands were present on the surface of the fibers.

Example 7

Nominal 1204d green pigmented ePTFE fiber was obtained (part # 215-3N; Lenzing Plastics, Lenzing, Austria), and a woven article was formed with this fiber having the following properties: 11.8 ends/cm in the warp direction by 11.8 picks/cm in the weft direction.

The woven article was plasma treated with an Atmospheric Plasma Treater (model number ML0061-01, Enercon Industries Corp., Menomonee Falls, Wis.) using argon gas. The process parameters were: argon flow rate of 50 L/min, power source of 2.5 kW, line speed of 3 m/min, 7.6 cm electrode length, 5 passes.

The woven plasma treated article was restrained on a pin frame and placed in a forced air oven (model number CW 7780F, Blue M Electric, Watertown, Wis.) set to 350 deg C. for 30 min. The article was removed from the oven and quenched in water at ambient temperature.

The article was examined with a scanning electron microscope. PTFE masses were observed to extend from at least one of the intersecting PTFE fibers and PTFE islands were observed on the surface of the fibers.

Example 8

A hydro-entangled article was made from this ePTFE fiber in the following manner. RASTEX® ePTFE Staple fiber (staple length 65-75 mm, with a fibril density of greater than 1.9 grams/cc, and a fibril denier greater than 15 denier per filament, available from W.L. Gore and Associates, Inc., Elkton, Md.) was obtained and opened using a fan (impeller type) opener. A finish of 1.5% by weight pick-up Katolin PTFE (ALBON-CHEMIE, Dr. Ludwig-E. Gminder K G, Carl-Zeiss-Str. 41, Metzingen, D72555, Germany) and 1.5% by weight pick-up Selbana UN (Cognis Deutschland GmbH, Dusseldorf, Germany) was applied to the staple fiber. Twenty hours after the finish was applied, the staple fiber was carded. A Hergeth Vibra-feed (Allstates Textile Machinery, Inc., Williamston, S.C.) was used to feed the staple fiber to the taker-in rollers on the card. The input speed to the card was 0.03 m/min. The main cylinder rotated to a surface speed of 2500 m/min. The working rollers rotated at surface speeds of 45 and 58 m/min. The fleece exited the card at a speed of 1.5 m/min. The humidity in the carding room was 62% at a temperature of 22-23° C. Subsequent to carding, the fleece was transported at a speed of 1.5 m/min on a transport belt having a pore size of 47 meshes/cm to a hydro-entanglement machine (AquaJet, Fleissner GmbH, Egelsbach, Germany) with a working width of 1 meter.

Two manifolds of the hydro-entanglement machine containing water jets subjected the fleece with streams of water under high pressure thereby creating a wet felt. A water pressure of 20 bar was used in both manifolds during the initial pass through the hydro-entangling process. The felt was then subjected again to the hydro-entanglement process using a water pressure on the first manifold at 100 bar and the second manifold at 150 bar. The speed of the felt through the process was 7 m/min. The wet felt was taken up on a winder. The wet felt passed through the hydro-entanglement machine a third time at a speed of 7.0 m/min. Only the first manifold was used to apply water streams to the felt. The pressure was 150 bar.

The speed of the felt during the third pass was 7 m/min. The felt was taken up on a plastic core using a winder and transported via a cart to a forced air oven set at 185° C. The oven opening was set at 4.0 mm. The wet felt was dried at speed of 1.45 m/min resulting in a dwell time of about 1.4 minutes. The dried felt was taken up on a cardboard core.

The hydro-entangled article was plasma treated with an Atmospheric Plasma Treater (model number ML0061-01, Enercon Industries Corp., Menomonee Falls, Wis.) using argon gas. The process parameters were: argon flow rate of 50 L/min, power source of 2.5 kW, line speed of 3 m/min, 7.6 cm electrode length, 20 passes.

The article was restrained on a pin frame and placed in a forced air oven (model number CW 7780F, Blue M Electric, Watertown, Wis.) set to 360 deg C. for 20 min. The article was removed from the oven and quenched in water at ambient temperature.

Figure 27:
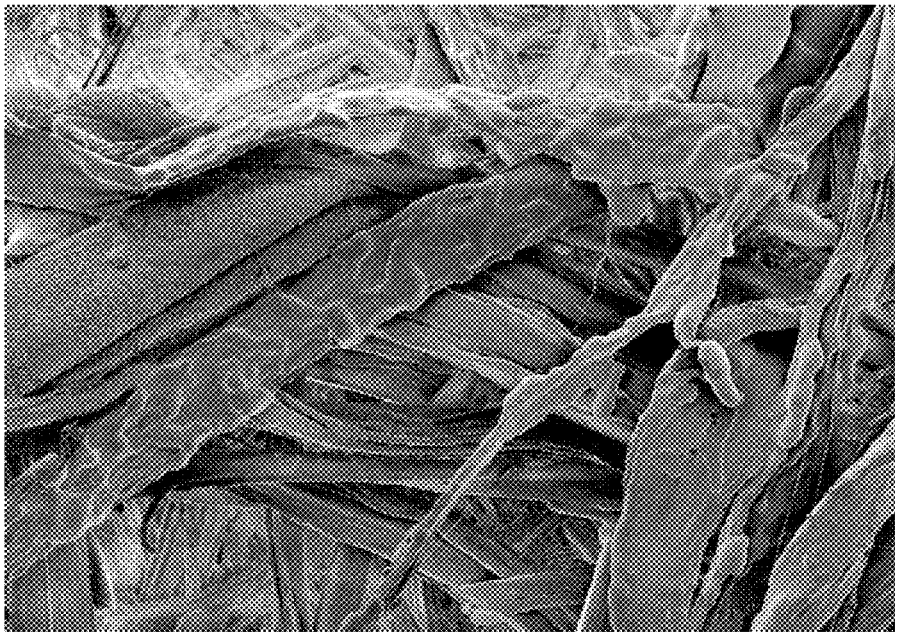
FIG. 27 is an SEM at 250× magnification of the surface of the article made in Example 8.

A scanning electron micrograph of the surface of this article at a magnification of 250× appears in FIG. 27, showing PTFE masses at fiber intersections, the masses extended from at least one of the intersecting PTFE fibers and PTFE islands on the non-intersecting surfaces of the fibers.

Example 9

A shaped article of the present invention was constructed in the following manner.

A woven plasma-treated, but not subsequently heat treated, material formed as described in Example 2 was obtained. The material was wrapped completely around a 25.4 mm diameter steel ball bearing. The excess material was gathered at the base of the bearing, twisted, and secured in place with a wire tie. The wrapped bearing was placed in a forced air oven (model number CW 7780F, Blue M Electric, Watertown, Wis.) set to 350 deg C. for 30 minutes.

The wrapped bearing was removed from the oven and quenched in water at ambient temperature. The tied end was cut and the material was removed from the bearing. The material retained the spherical shape of the bearing when placed on a flat surface. FIG. 38 is a photograph showing the article.

Example 10

The ePTFE fabric of Example 1a was obtained and filled with an ionomer in the following manner. DuPont™ Nafion® 1100 ionomer (DuPont, Wilmington, Del.) was obtained and diluted to create a 24% by weight solids solution in 48% ethanol and 28% water. A 5 cm×5 cm piece of the ePTFE fabric was cut and its edges were taped to an ETFE release film (0.1 mm, DuPont Tefzel® film). Approximately 5 g of the ionomer solution was poured onto the ePTFE fabric, which served as a stabilized woven support. The materials were placed in an oven at 60 deg C. for 1 hour to dry the solvents from the ionomer solution. A second coating of approximately 5 g was applied to the support and the materials were dried again in the same manner. Following drying, the resultant filled membrane was placed in a heated platen Carver press with both platens set to 175 deg C. and pressed at 4536 kg for 5 minutes to eliminate air bubbles and other inconsistencies in the film.

FIG. 39 is an SEM of the cross-section of the article of this Example at 250× magnification showing the encapsulation of the fabric with the ionomer.

Example 11

A hot-pressed laminate of DuPont™ Nafion® 1100 ionomer (DuPont, Wilmington, Del.) and ePTFE was created in the following manner. An ionomer solution was prepared as described in Example 10. Approximately 5 g of the ionomer solution was poured onto an ETFE release film. The release film plus ionomer were placed in an oven at 60 deg C. for 1 hour to dry the solvents from the ionomer solution. In this way, a free standing ionomer film was created. A second ionomer film was made in the same manner.

The ePTFE fabric of Example 1a was obtained and cut to 5 cm×5 cm to serve as a stabilized ePTFE woven support. The stabilized ePTFE woven support was sandwiched between the two fabricated ionomer films. The sandwich structure was then placed between two pieces of ETFE release film and placed in a heated platen Carver press with both platens set to 175 deg C. The materials were pressed at 4536 kg for 5 minutes to incorporate the ionomer into the ePTFE woven fabric. FIG. 40 is an SEM at 250× of the material formed in this Example showing the encapsulation of the fabric with the ionomer.

The invention claimed is:

1. An article comprising:

a plurality of PTFE fibers overlapping at intersections, wherein at least a portion of the intersections have PTFE masses extending from at least one of the overlapping PTFE fibers, and which mechanically lock the overlapping PTFE fibers.

2. The article of claim 1, wherein said plurality of PTFE fibers overlapping at intersections comprises a structure selected from the group consisting of knitted fibers, woven fibers, a laid scrim of fibers and nonwoven fibers.

3. The article of claim 1, wherein said PTFE fibers comprise expanded PTFE.

4. The article of claim 1, wherein said PTFE fibers comprise a plurality of PTFE monofilaments combined in a twisted configuration.

5. The article of claim 1, wherein said PTFE fibers comprise one or more forms selected from the group consisting of monofilaments, multifilaments and staple fibers.

6. The article of claim 1, wherein said PTFE fibers comprise one or more geometries selected from the group consisting of round, flat and twisted.

7. The article of claim 1, wherein said PTFE fibers comprise at least one additional material.

8. The article of claim 1, wherein said article further comprises PTFE islands on at least some PTFE fibers.

9. The article of claim 1, further comprising at least one additional material incorporated in said article.

10. The article of claim 1, further comprising at least one additional material coated on at least a portion of said PTFE fibers.

11. The article of claim 1, further comprising at least one additional material impregnated into the article.

12. The article of claim 11, wherein said at least one additional material comprises at least one ionomer.

13. The article of claim 1, wherein said article comprises a layer of a multi-layered structure.

14. The article of claim 1, wherein said article comprises a component of an electrochemical cell.

15. The article of claim 1, wherein said article comprises a component of an electrochemical cell.

16. The article of claim 1, wherein said article comprises a component of an acoustic device.

17. The article of claim 1, wherein said article comprises a component of a filter.

18. The article of claim 1, wherein said article comprises a component of a medical device.

19. The article of claim 1 having a geometry selected from the group consisting of a membrane, a tube, a sheet and a three dimensional shape.

20. The article of claim 18, incorporated as a component of an implantable medical device.

21. A method for forming a PTFE article comprising:

forming a plurality of PTFE fibers into a structure having intersections of overlapping PTFE fibers;

subjecting the structure to a plasma treatment; then subjecting the plasma treated structure to a heat treatment, whereby at least a portion of the intersection of the resulting structure have PTFE masses, said PTFE masses extending from at least one of the overlapping PTFE fibers.

* * * * *